US008523238B2

(12) United States Patent
Sekine et al.

(10) Patent No.: US 8,523,238 B2
(45) Date of Patent: Sep. 3, 2013

(54) LIGHT-EMITTING MEDIUM AND METHOD OF CONFIRMING LIGHT-EMITTING MEDIUM

(75) Inventors: Yoko Sekine, Bunkyo-Ku (JP); Manabu Yamamoto, Ichikawa (JP); Mitsuru Kitamura, Suginami-Ku (JP); Tsuyoshi Yamauchi, Abiko (JP); Akiko Kitamura, Nagareyama (JP); Sakurako Hatori, Nagareyama (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days.

(21) Appl. No.: 13/814,094

(22) PCT Filed: Aug. 4, 2011

(86) PCT No.: PCT/JP2011/067878
§ 371 (c)(1),
(2), (4) Date: Feb. 4, 2013

(87) PCT Pub. No.: WO2012/018084
PCT Pub. Date: Feb. 9, 2012

(65) Prior Publication Data

US 2013/0127151 A1 May 23, 2013

(30) Foreign Application Priority Data

Aug. 4, 2010 (JP) ..... 2010-175709
May 27, 2011 (JP) ..... 2011-119208

(51) Int. Cl.
*B42D 15/00* (2006.01)

(52) U.S. Cl.
USPC ..... 283/92; 283/114

(58) Field of Classification Search
USPC ..... 283/92, 114
See application file for complete search history.

(56) References Cited

U.S. PATENT DOCUMENTS

| | | | | |
|---|---|---|---|---|
| 7,575,253 | B2 * | 8/2009 | Iwanaga | 283/92 |
| 7,654,581 | B2 * | 2/2010 | Cruikshank et al. | 283/92 |
| 2009/0301676 | A1 * | 12/2009 | Rosset et al. | 162/140 |

FOREIGN PATENT DOCUMENTS

| | | | |
|---|---|---|---|
| EP | 1 179 808 | A1 | 2/2002 |
| EP | 2 075 767 | A1 | 7/2009 |
| JP | 10-251570 | A1 | 9/1998 |
| JP | 10-315605 | A1 | 12/1998 |
| JP | 2006-274097 | A1 | 10/2006 |
| JP | 2008-162184 | A1 | 7/2008 |
| JP | 4418881 | B2 | 2/2010 |

OTHER PUBLICATIONS

International Search Report dated Aug. 30, 2011 (with English translation).

* cited by examiner

*Primary Examiner* — Kyle Grabowski
(74) *Attorney, Agent, or Firm* — Burr & Brown

(57) ABSTRACT

There is provided a light-emitting medium by which whether a valuable paper or the like is forged or not can be judged easily and promptly. A light-emitting medium constituting a valuable paper includes a light-emitting image. The light-emitting image is composed of a pattern area formed on a substrate by using a first fluorescent ink containing a first fluorescent material, and a background area formed on the substrate by using a second fluorescent ink containing a second fluorescent material. When UV-A is irradiated, the first fluorescent ink and the second fluorescent ink emit light of colors that are viewed as different colors from each other. In addition, when UV-C is irradiated, the first fluorescent ink and the second fluorescent ink emit light of colors that are viewed as different colors from each other, the colors being different from the colors that are viewed when the UV-A is irradiated.

23 Claims, 18 Drawing Sheets

LIGHT-EMITTING MEDIUM AND METHOD OF CONFIRMING LIGHT-EMITTING MEDIUM

TECHNICAL FIELD

The present invention relates to a light-emitting medium including a light-emitting image which appears when invisible light within a specific wavelength range is irradiated thereon. In addition, the present invention relates to a method of confirming the light-emitting medium.

BACKGROUND ART

In media such as valuable papers including cash vouchers and prepaid cards, identity cards including licenses, etc. which should be anti-counterfeit, there have been recently used a micro character, a copy guard pattern, an infrared-light absorbing ink, a fluorescent ink and so on, in order to improve security. The fluorescent ink is an ink including a fluorescent material which cannot be almost viewed under visible light, and can be viewed when invisible light (ultraviolet light or infrared light) is irradiated. With the use of such a fluorescent ink, there can be formed, on a valuable paper or the like, a fluorescent image (light-emitting image) which appears only when visible light within a specific wavelength range is irradiated. Thus, it is possible to prevent that the valuable paper is easily forged by a generally used color printer or the like.

In addition, in order to further improve the anti-counterfeit effect, there is proposed that a light-emitting image, which cannot be viewed by the naked eye, is formed on a variable paper by means of a fluorescent ink. For example, Patent Document 1 discloses a medium including a light-emitting image formed by using a first fluorescent ink and a second fluorescent ink. In this case, when seen with the naked eye, the first fluorescent ink and the second fluorescent ink are viewed as the same color with each other, under visible light and ultraviolet light. On the other hand, when seen through a judging tool, the first fluorescent ink and the second fluorescent ink are viewed as different colors from each other. Thus, the light-emitting image formed on the valuable paper cannot be easily forged, whereby the anti-counterfeit effect through the fluorescent inks can be enhanced.

Patent Document 1: JP4418881B

SUMMARY OF INVENTION

A procedure for judging whether a valuable paper is a counterfeit one or not is preferably performed easily and promptly. In addition, in order to make it more difficult that a valuable paper is forged, a medium constituting the valuable paper preferably exhibits various reactions against different irradiated light. Namely, there is demand for a medium by which whether a valuable paper is a counterfeit one or not can be easily and reliably judged by the naked eye, without using any tool such as a judging tool or the like.

The object of the present invention is to provide a light-emitting medium and a method of confirming the light-emitting medium, which are capable of effectively solving such a problem.

The present invention is a light-emitting medium including a light-emitting image on a substrate, wherein: the light-emitting image includes a first area containing a first fluorescent material and a second area containing a second fluorescent material; when invisible light within a first wavelength range is irradiated, the first fluorescent material and the second fluorescent material emit light of colors that are viewed as different colors from each other; and when invisible light within a second wavelength range is irradiated, the first fluorescent material and the second fluorescent material emit light of colors that are viewed as different colors from each other, the colors being different from the colors that are viewed when the invisible light within the first wavelength range is irradiated.

In the light-emitting medium according to the present invention, when the invisible light within the first wavelength range and the invisible light within the second wavelength range are simultaneously irradiated, the first fluorescent material and the second fluorescent material may emit light of colors that are viewed as the same color with each other. Alternatively, when the invisible light within the first wavelength range and the invisible light within the second wavelength range are simultaneously irradiated, the first fluorescent material and the second fluorescent material may emit light of colors that are viewed as different colors from each other.

In the light-emitting medium according to the present invention, when the invisible light within the first wavelength range and the invisible light within the second wavelength range are simultaneously irradiated, a color difference between the color of the light emitted from the first fluorescent material and the color of the light emitted from the second fluorescent material is preferably not more than 10, and more preferably not more than 3.

In the light-emitting medium according to the present invention, the first fluorescent material may emit light of a first color when the invisible light within the first wavelength range is irradiated, and emit light of a second color when the invisible light within the second wavelength range is irradiated, and the second fluorescent material may emit light of the second color or light of a color that is viewed as the same color with the second color when the invisible light within the first wavelength range is irradiated, and emit light of the first color or light of a color that is viewed as the same color with the first color when the invisible light within the second wavelength range is irradiated.

In the light-emitting medium according to the present invention, a color difference between the color of the light emitted from the first fluorescent material, when the invisible light within the first wavelength range is irradiated, and the color of the light emitted from the second fluorescent material, when the invisible light within the second wavelength range is irradiated, is preferably not more than 10, and more preferably not more than 3. In addition, a color difference between the color of the light emitted from the second fluorescent material, when the invisible light within the first wavelength range is irradiated, and the color of the light emitted from the first fluorescent material, when the invisible light within the second wavelength range is irradiated, is preferably not more than 10, and more preferably not more than 3.

In the light-emitting medium according to the present invention, it is preferable that, when the invisible light within the first wavelength range and the invisible light within the second wavelength range are simultaneously irradiated, the first fluorescent material and the second fluorescent material emit light of colors that are viewed as the same color with each other, the colors being viewed as the same color with a color of the substrate.

In the light-emitting medium according to the present invention, the first area and the second area may be respectively formed of the first fluorescent material and the second fluorescent material provided in an identical predetermined pattern.

In the light-emitting medium according to the present invention, at least a part of the second area may be adjacent to the first area.

In the light-emitting medium according to the present invention, the first area may include at least one first design area containing the first fluorescent material; the second area may include at least one second design area containing the second fluorescent material; and the first design area and the second design area may be located independently from each other. In this case, a shape of the first deign area may be substantially the same as a shape of the second design area.

The present invention is a method of confirming a light-emitting medium including a light-emitting image on a substrate, the method including: preparing the aforementioned light-emitting medium; confirming that the first area of the light-emitting image and the second area thereof are discriminated from each other upon irradiating the invisible light within the first wavelength range on the light-emitting medium; and confirming that the first area of the light-emitting image and the second area thereof are discriminated from each other upon irradiating the invisible light within the second wavelength range on the light-emitting medium.

The method of confirming a light-emitting medium according to the present invention may further include confirming that the first area of the light-emitting image and the second area thereof are not discriminated from each other, by simultaneously irradiating the invisible light within the first wavelength range and the invisible light within the second wavelength range.

The light-emitting medium of the present invention includes the light-emitting image on the substrate. The light-emitting image includes the first area containing the first fluorescent material and the second area containing the second fluorescent material. Herein, when the invisible light within the first wavelength range is irradiated, the first fluorescent material and the second fluorescent material emit light of colors that are viewed as different colors from each other. When the invisible light within the second wavelength range is irradiated, the first fluorescent material and the second fluorescent material emit light of colors that viewed as different colors from each other, the colors being different from the colors that are viewed when the invisible light within the first wavelength range is irradiated. Thus, the pattern of the light-emitting image constituted by the first area and the second area can be viewed, when the invisible light within the first wavelength range is irradiated or when the invisible light within the second wavelength range is irradiated. Therefore, it is possible to confirm the light-emitting image easily and reliably.

DESCRIPTION OF EMBODIMENTS

First Embodiment

A first embodiment of the present invention will be described herebelow with reference to FIGS. 1 to 6C. At first, an anti-counterfeit medium 10 formed of a light-emitting medium of the present invention is described as a whole with reference to FIGS. 1 to 3.

Anti-Counterfeit Medium

Figure 1:
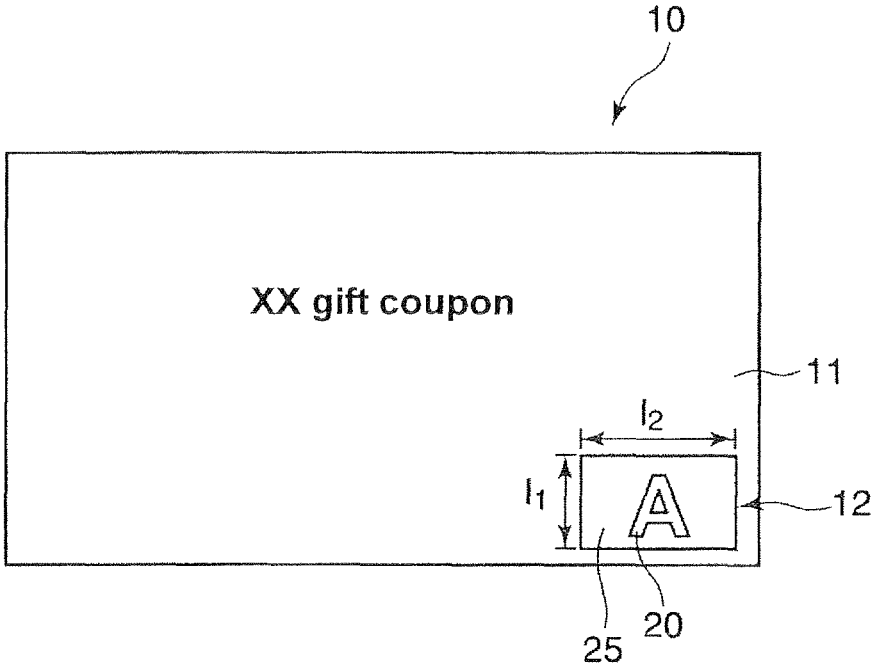
FIG. 1 is a plan view showing an example of a valuable paper constituted by an anti-counterfeit medium formed of a light-emitting medium of the present invention.

FIG. 1 is a view showing an example of a valuable paper such as a gift coupon constituted by the anti-counterfeit medium 10 according to this embodiment. As shown in FIG. 1, the anti-counterfeit medium 10 includes a substrate 11 and a light-emitting image 12 formed on the substrate. In this example, as described below, the light-emitting image 12 functions as an authenticity judging image for judging authenticity of the anti-counterfeit medium 10. As shown in FIG. 1, the light-emitting image 12 is composed of a pattern area (first area) 20 and a background area (second area) 25 formed to be adjacent to the pattern area 20. In the example shown in FIG. 1, the pattern area 20 is defined by a character (pattern) "A", and the background area 25 is formed to surround the pattern area 20. As described below, each of the areas 20 and 25 is formed by printing a fluorescent ink that is excited by invisible light to emit fluorescence light.

A material of the substrate 11 used in the anti-counterfeit medium 10 is not specifically limited, and the material is suitably selected depending on a type of a valuable paper constituted by the anti-counterfeit medium 10. For example, as a material of the substrate 11, there is used white polyethylene terephthalate having excellent printability and processability. A thickness of the substrate 11 is suitably set depending on a type of a valuable paper constituted by the anti-counterfeit medium 10.

A size of the light-emitting image 12 is not specifically limited, and the size is suitably set depending on easiness in authenticity judgment and required judgment precision. For example, a length $l_1$ and a length $l_2$ of the light-emitting image 12 are within a range of 1 to 210 mm and a range of 1 to 300 mm, respectively.

Light-Emitting Image

Figure 2:
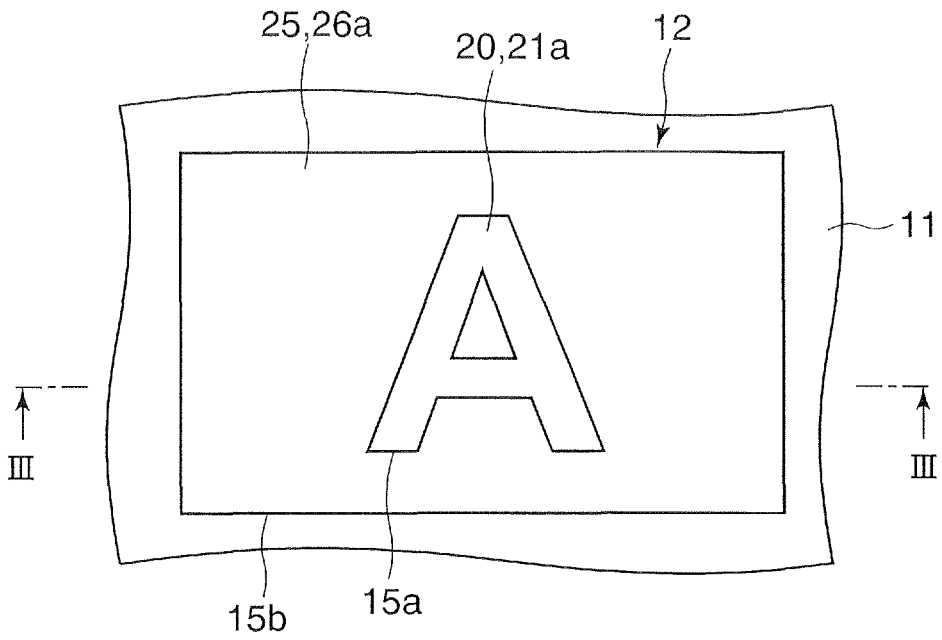
FIG. 2 is a plan view showing a light-emitting image of the anti-counterfeit medium in a first embodiment of the present invention
Figure 3:
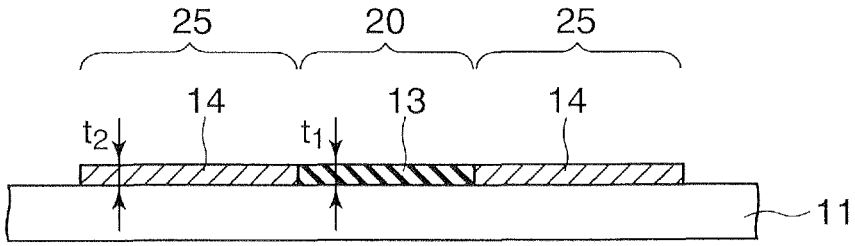
FIG. 3 is a sectional view taken along a line of the light-emitting image shown in FIG. 2.

Next, the light-emitting image 12 is described in more detail with reference to FIGS. 2 and 3. FIG. 2 is a plan view showing the light-emitting image 12 in enlargement under visible light. FIG. 3 is a sectional view taken along a line III-III of the light-emitting image 12 shown in FIG. 2.

Referring firstly to FIG. 3, a structure of the light-emitting image 12 is described. As shown in FIG. 3, the pattern area 20 of the light-emitting image 12 and the background area 25 thereof are formed by solid-printing a first fluorescent ink 13 and a second fluorescent ink 14 on the substrate 11.

FIG. 3 shows the example in which the first fluorescent ink 13 of the pattern area 20 and the second fluorescent ink 14 of the background area 25 are in contact with each other. However, not limited thereto, a gap, which cannot be viewed by the naked eye, may be defined between the first fluorescent ink 13 of the pattern area 20 and the second fluorescent ink 14 of the background area 25. Alternatively, between the first fluorescent ink 13 of the pattern area 20 and the second fluorescent ink 14 of the background area 25, the first fluorescent ink 13 and the second fluorescent ink 14 may be overlapped with each other.

A thickness $t_1$ of the first fluorescent ink 13 and a thickness $t_2$ of the second fluorescent ink 14 are suitably set depending on a type of a valuable paper, a printing method and so on. For example, the thickness $t_1$ is within a range of 0.3 to 100 μm, and the thickness $t_2$ is within a range of 0.3 to 100 μm. Preferably the thickness $t_1$ and the thickness $t_2$ are substantially the same with each other. Due to this structure, a boundary between the pattern area 20 and the background area 25 can be restrained from being viewed, which might be caused by a difference between the thickness of the first fluorescent ink 13 and the thickness of the second fluorescent ink 14.

As described below, the first fluorescent ink 13 and the second fluorescent ink 14 respectively contain predetermined fluorescent materials, such as particulate pigments, which do not emit light under visible light and emit light under specific invisible light. Herein, for example, a particle diameter of the pigments contained in the inks 13 and 14 is within a range of 0.1 to 10 μm, preferably within a range of 0.1 to 3 μm. Thus, when the visible light is irradiated on the inks 13 and 14, the light is scattered by the pigment particles. Therefore, as shown in FIG. 2, when the light-emitting image 12 is seen under the visible light, a white pattern area 21*a* is viewed as the pattern area 20, and a white background area 26*a* is viewed as the background area 25. As described above, the substrate 11 is made of white polyethylene terephthalate. For this reason, all of the substrate 11, the pattern area 20 of the light-emitting image 12 and the background area 25 thereof are viewed white areas. As a result, the pattern of the pattern area 20 of the light-emitting image 12 will not appear under the visible light. Accordingly, it is possible to prevent that the anti-counterfeit medium 10 including the light-emitting image 12 is easily forged.

In FIG. 2, a first boundary line 15*a* between the pattern area 20 and the background area 25 and a second boundary line 15*b* between the substrate 11 and the light-emitting image 12 are drawn as a matter of convenience. Under the visible light, the first boundary line 15*a* and the second boundary line 15*b* cannot be actually viewed.

Fluorescent Inks

Figure 4A:
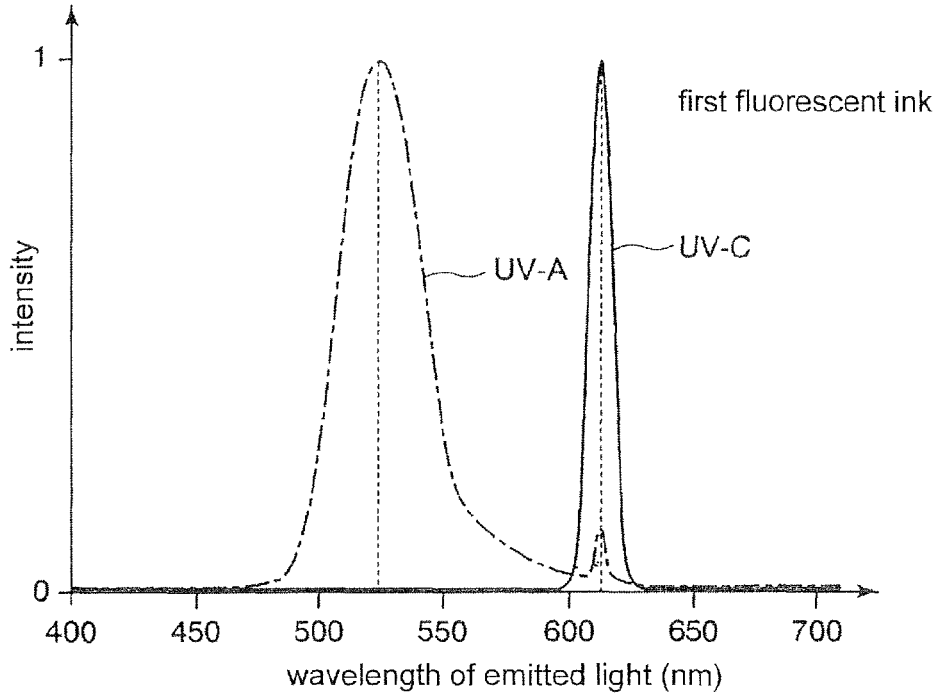
FIG. 4A is a view showing a fluorescence emission spectrum of a first fluorescent ink in the first embodiment of the present invention.
Figure 4B:
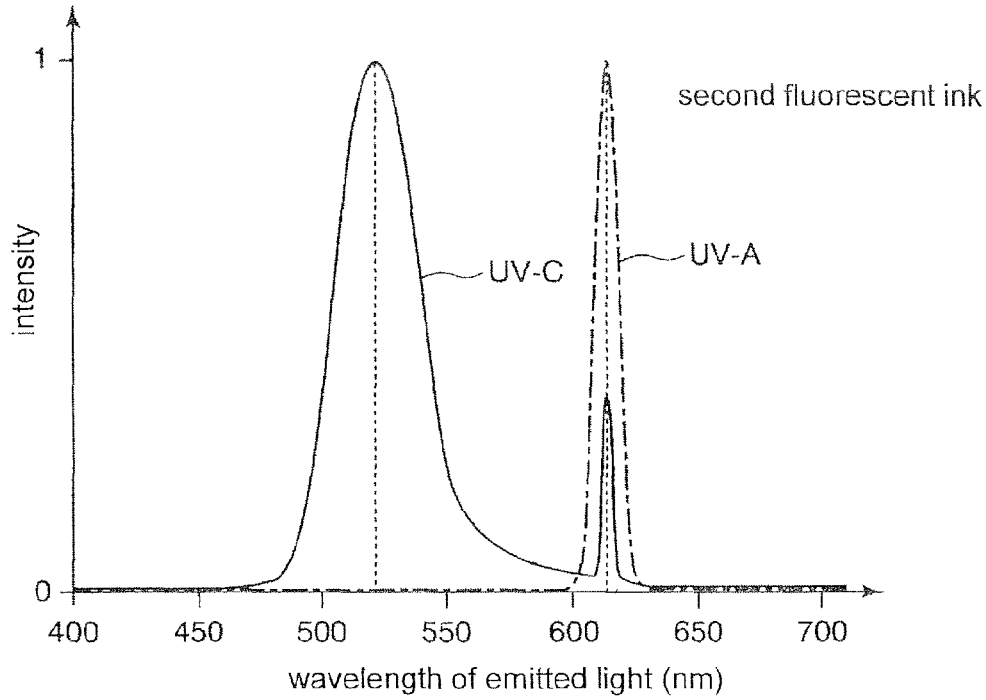
FIG. 4B is a view showing a fluorescence emission spectrum of a second fluorescent ink in the first embodiment of the present invention.
Figure 5:
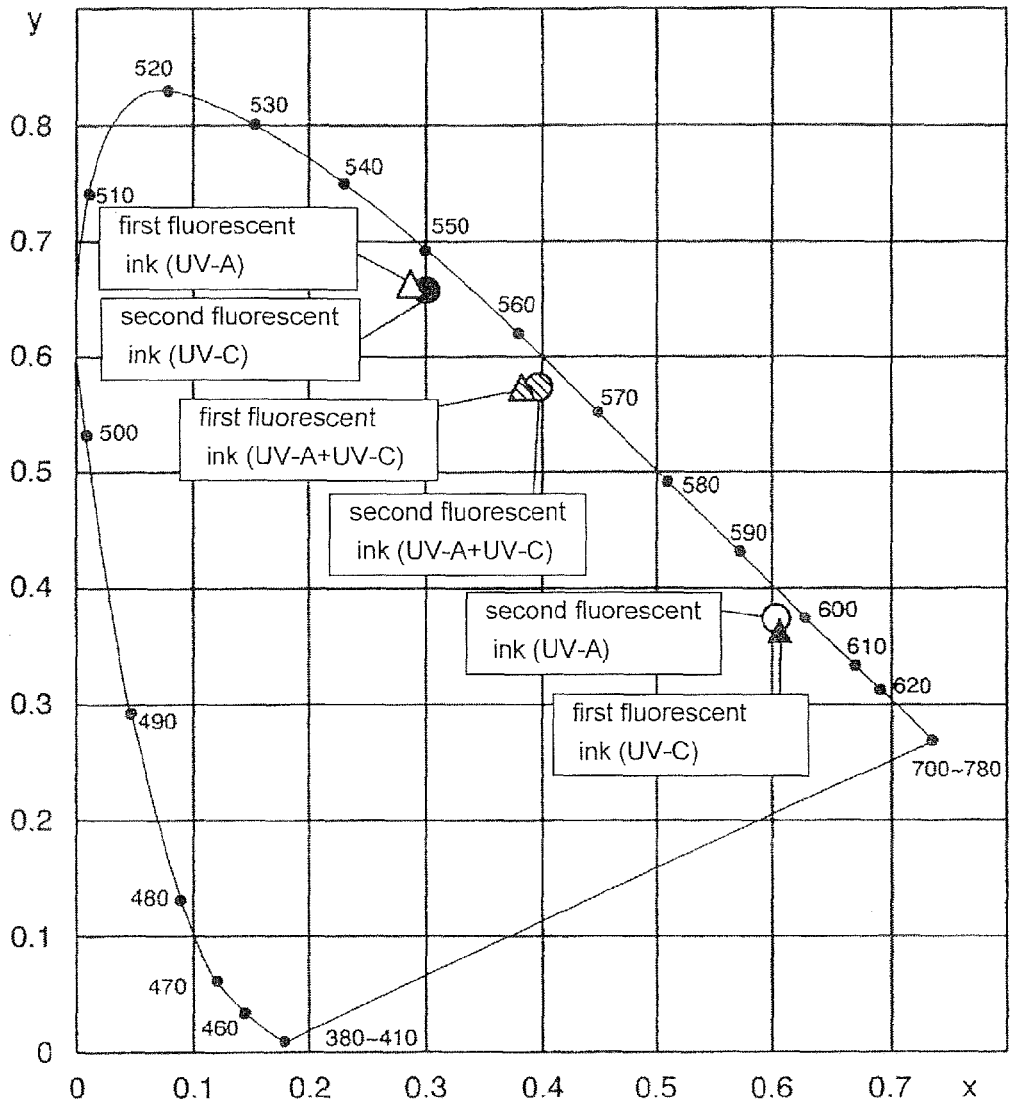
FIG. 5 is an xy chromaticity diagram showing chromaticities of fluorescent light emitted from the first fluorescent ink and chromaticities of fluorescent light emitted from the second fluorescent ink, in the first embodiment of the present invention.

Next, the first fluorescent ink 13 and the second fluorescent ink 14 are described in more detail with reference to FIGS. 4A to 5. FIG. 4A is a view showing a fluorescence emission spectrum of the first fluorescent ink 13, and FIG. 4B is a view showing a fluorescence emission spectrum of the second fluorescent ink 14. FIG. 5 is an xy chromaticity diagram showing, by means of an XYZ colorimetric system, chromaticities of light emitted from the first fluorescent ink 13 and chromaticities of fluorescent light emitted from the second fluorescent ink 14 when light within a specific wavelength range is irradiated.

(First Fluorescent Ink)

The first fluorescent ink 13 is firstly described. In FIG. 4A, the one-dot chain lines show the fluorescence emission spectrum of the first fluorescent ink 13, when ultraviolet light (invisible light) within a wavelength range of 315 to 400 nm (within a first wavelength range), i.e., so-called UV-A is irradiated. The solid line shows the fluorescence emission spectrum of the first fluorescent ink 13, when ultraviolet light (invisible light) within a wavelength range of 200 to 280 nm (within a second wavelength range), i.e., so-called UV-C is irradiated. Each fluorescence emission spectrum shown in FIG. 4A is normalized such that a peak intensity at the maximum peak is 1.

As shown in FIG. 4A, when the UV-A is irradiated, the first fluorescent ink 13 emits light of green color (first color) having a peak wavelength $\lambda_{1A}$ of about 520 nm. On the other hand, when the UV-C is irradiated, the first fluorescent ink 13 emits light of red color (second color) having a peak length $\lambda_{1C}$ of about 605 nm. Namely, the first fluorescent ink 13 contains a dichromatic fluorescent material (first fluorescent material) which emits light of different colors which differ from when the UV-A is irradiated to when the UV-C is irradiated. Such a dichromatic fluorescent material can be obtained by suitably combining, e.g., a fluorescent material that is excited by the UV-A and a fluorescent material that is excited by the UV-C (see, for example, JP10-251570A).

As shown in FIG. 4A, when the UV-A is irradiated, light having a wavelength of about 605 nm is also emitted. However, the light having a wavelength of about 605 nm has an intensity that is smaller than an intensity of the light having a peak wavelength $\lambda_{1A}$ of about 520 nm. Thus, when the UV-A is irradiated, the light emitted from the first fluorescent ink 13 is viewed as light of green color.

(Second Fluorescent Ink)

Next, the second fluorescent ink 14 is described. In FIG. 4B, the one-dot chain lines show the fluorescence emission spectrum of the first fluorescent ink 14 when the UV-A is irradiated. The solid line shows the fluorescence emission spectrum of the second fluorescent ink 14 when the UV-C is irradiated. Similarly to the case shown in FIG. 4A, each fluorescence emission spectrum shown in FIG. 4B is normalized such that a peak intensity at the maximum peak is 1.

As shown in FIG. 4B, when the UV-A is irradiated, the second fluorescent ink 14 emits light having a peak wavelength $\lambda_{2A}$ of about 610 nm, which is light of red color (second color) or light of a color that is viewed as the same color as the red color (second color). On the other hand, when the UV-C is irradiated, the second fluorescent ink 14 emits light having a peak wavelength $\lambda_{2C}$ of about 525 nm, which is light of green color (first color) or light of a color that is viewed as the same color as the green color (first color). Namely, similarly to the first fluorescent ink 13, the second fluorescent ink 14 contains a so-called dichromatic fluorescent material which emits light of different colors which differ from when the UV-A is irradiated to when the UV-C is irradiated.

As shown in FIG. 4B, when the UV-C is irradiated, light having a wavelength of about 610 nm is also emitted. However, the light having a wavelength of about 610 nm has an intensity that is smaller than an intensity of the light having a peak wavelength $\lambda_{2A}$ of about 525 nm. Thus, when the UV-C is irradiated, the light emitted from the second fluorescent ink 14 is viewed as light of green color.

Next, the colors of light emitted from the first fluorescent ink 13 and the second fluorescent ink 14 are described in more detail with reference to FIG. 5. As to symbols shown in FIG. 5, a blank triangle represents a chromaticity of light emitted from the first fluorescent ink 13 upon irradiation of the UV-A, and a blank circle represents a chromaticity of light emitted from the second fluorescent ink 14 upon irradiation of the UV-A. A black triangle represents a chromaticity of light emitted from the first fluorescent ink 13 upon irradiation of the UV-C, and a black circle represents a chromaticity of light emitted from the second fluorescent ink 14 upon irradiation of the UV-C. A shaded triangle represents a chromaticity of light emitted from the first fluorescent ink 13 upon simultaneous irradiation of the UV-A and the UV-C, and a shaded circle represents a chromaticity of light emitted from the second fluorescent ink 14 upon simultaneous irradiation of the UV-A and the UV-C.

The aforementioned green color (first color) corresponds to the chromaticity represented by the blank triangle in FIG. 5, and the aforementioned red color (second color) corresponds to the chromaticity represented by the black triangle in FIG. 5.

As shown in FIG. 5, in the xy chromaticity diagram, the chromaticity of the light emitted from the first fluorescent ink 13 upon irradiation of the UV-A and the chromaticity of the light emitted from the second fluorescent ink 14 upon irradiation of the UV-A are greatly distant from each other. Thus, the light emitted from the second fluorescent ink 14 upon irradiation of the UV-A is viewed as light whose color is different from a color of the light emitted from the first fluorescent ink 13 upon irradiation of the UV-A. Therefore, the pattern area 20 formed with the use of the first fluorescent ink 13 and the background area 25 formed with the use of the second fluorescent ink 14 are viewed as areas of different colors, when the UV-A is irradiated. As a result, as described below, when the UV-A is irradiated, the pattern of the pattern area 20 can be viewed.

In addition, as shown in FIG. 5, in the xy chromaticity diagram, the chromaticity of the light emitted from the first fluorescent ink 13 upon irradiation of the UV-C and the chromaticity of the light emitted from the second fluorescent ink 14 upon irradiation of the UV-C are greatly distant from each other. Thus, the light emitted from the second fluorescent ink 14 upon irradiation of the UV-C is viewed as light whose color is different form the light emitted from the first fluorescent ink 13 upon irradiation of the UV-C. Therefore, the pattern area 20 formed with the use of the first fluorescent ink 13 and the background area 25 formed with the use of the second fluorescent ink 14 are viewed as areas of different colors, when the UV-C is irradiated. As a result, as described below, when the UV-C is irradiated, the pattern of the pattern area 20 can be also viewed.

On the other hand, as shown in FIG. 5, in the xy chromaticity diagram, the chromaticity of the light emitted from the first fluorescent ink 13 upon simultaneous irradiation of the UV-A and the UV-C and the chromaticity of the light emitted from the second fluorescent ink 14 upon simultaneous irradiation of the UV-A and the UV-C are close to each other. Thus, the light emitted from the second fluorescent ink 14 upon simultaneous irradiation of the UV-A and the UV-C is viewed as light whose color is the same as the light emitted from the first fluorescent ink 13 upon simultaneous irradiation of the UV-A and the UV-C. Thus, the pattern area 20 formed with the use of the first fluorescent ink 13 and the background area 25 formed with the use of the second fluorescent ink 14 are viewed as areas of the same color, when the UV-A and the UV-C are simultaneously irradiated. As a result, as described below, when the UV-A and the UV-C are simultaneously irradiated, the overall light-emitting image 12 is viewed as an image of yellow color (third color), and thus the pattern of the pattern area 20 does not appear.

Described in more detail below is a mechanism by which, when the UV-A and the UV-C are simultaneously irradiated, the light (light (2AC)) emitted from the second fluorescent ink 14 and the light (light (1AC)) emitted from the first fluorescent ink 13 become the light of the same color.

As shown in FIG. 5, in the xy chromaticity diagram, the chromaticity of the light (light (1A)) emitted from the first fluorescent ink 13 upon irradiation of the UV-A and the chromaticity of the light (light (2C)) emitted from the second fluorescent ink 14 upon irradiation of the UV-C are close to each other. Similarly, in the xy chromaticity diagram, the chromaticity of the light (light (1C)) emitted from the first fluorescent ink 13 upon irradiation of the UV-C and the chromaticity of the light (light 2A)) emitted from the second fluorescent ink 14 upon irradiation of the UV-A are close to each other.

When the UV-A and the UV-C are simultaneously irradiated, the color of the light (1AC) emitted from the first fluorescent ink 13 appears as an additive mixture of colors of the color of the light (1A) and the color of the light (1C). Similarly, when the UV-A and the UV-C are simultaneously irradiated, the color of the light (2AC) emitted from the second fluorescent ink 14 appears as an additive mixture of colors of the color of the light (2A) and the color of the light (2C). As described above, the chromaticity of the light (1A) and the chromaticity of the light (2C) are close to each other, and the chromaticity of the light (1C) and the chromaticity of the light (2A) are close to each other. In this case, by suitably adjusting an intensity ratio between the light (2A) and the light (2C), the chromaticity of the light (2AC) that is obtained based on the light (2A) and the light (2C) can be brought close to the chromaticity of the light (1AC) that is obtained based on the light (1A) and the light (1C), which is shown in FIG. 5. Therefore, when the UV-A and the UV-C are simultaneously irradiated, the light (2AC) emitted from the second fluorescent ink 14 is viewed as light of the same color as the light (1AC) emitted from the first fluorescent ink 13.

In the present invention, the "same color" means that chromaticities of two colors are so close to each other that the difference in colors cannot be discriminated by the naked eye. To be more specific, the "same color" means that a color difference $\Delta E^*_{ab}$ between two colors is not more than 10, preferably not more than 3. The "different colors" means that the color difference $\Delta E^*_{ab}$ between the two colors is greater than 10. The color difference $\Delta E^*_{ab}$ is a value that is calculated based on L*, a* and b* in an L*a*b* colorimetric system, and is a value as a reference relating to a difference in colors when observed by the naked eye. L*, a* and b* in the L*a*b* colorimetric system and tristimulus values X, Y and Z in an XYZ colorimetric system are calculated based on a light spectrum and so on. There is a relationship according to a well-known transformation among L*, a* and b*, and the tristimulus values X, Y and Z.

The above tristimulus values can be measured by using, a measuring device such as a spectrophotometer, a differential colorimeter, a chromatometer, a colorimeter, a chromoscope, etc. Among these measuring devices, since the spectrophotometer can obtain a spectrum reflectance of each wavelength, the spectrophotometer can precisely measure the tristimulus values and thus is suited for analysis of color difference.

A procedure for calculating a color difference $\Delta E^*_{ab}$ is as follows. For example, light from a plurality of media (inks) to be compared is measured by the spectrophotometer in the first place, and then the tristimulus values X, Y and Z or L*, a* and b* are calculated based on the result. Thereafter, a color difference is calculated from differences ΔL*, Δa* and Δb* of L*, a* and b* in the plurality of media (inks), based on the following expression.

$$\Delta E^*_{ab}=[(\Delta L^*)^2+(\Delta a^*)+(\Delta b^*)^2]^{1/2} \quad \text{Expression 1:}$$

Next, an operation of this embodiment as structured above is described. Herein, a method of manufacturing the anti-counterfeit medium 10 is firstly described. Next, there is described a method of examining whether a valuable paper formed of the anti-counterfeit medium 10 is genuine or not.

Method of Manufacturing Anti-Counterfeit Medium

At first, the substrate 11 is prepared. As the substrate 11, there is used a 188-μm thick substrate made of white polyethylene terephthalate. Then, by using the first fluorescent ink 13 and the second fluorescent ink 14, the light-emitting image 12 composed of the pattern area 20 and the background area 25 is formed on the substrate 11.

At this time, as the first fluorescent ink 13 and the second fluorescent ink 14, there are used offset lithographic inks each of which is obtained by, for example, adding 8 wt % of microsilica, 2 wt % of organic bentonite, 50 wt % of alkyd resin and 15 wt % of alkyl benzene-based solvent, to 25 wt % of dichromatic fluorescent material having predetermined fluorescent properties. As the dichromatic material (first fluorescent material) for the first fluorescent ink 13, there is used a fluorescent material DE-RG (manufactured by Nemoto & Co., Ltd.) that emits light of red color when being excited by ultraviolet light having a wavelength of 254 nm, emits light of green color when being excited by ultraviolet light having a wavelength of 365 nm, and emits light of yellow color when being simultaneously irradiated by ultraviolet light having a wavelength of 254 nm and ultraviolet light having a wavelength of 365 nm. As the dichromatic material (second fluorescent material) for the second fluorescent ink 14, there is used a fluorescent material DE-GR (manufactured by Nemoto & Co., Ltd.) that emits light of green color when being excited by ultraviolet light having a wavelength of 254 nm, emits light of red color when being excited by ultraviolet light having a wavelength of 365 nm, and emits light of yellow color when being simultaneously irradiated by ultraviolet light having a wavelength of 254 nm and ultraviolet light having a wavelength of 365 nm.

In this embodiment, the dichromatic fluorescent materials of the first and second fluorescent inks 13 and 14 are respectively selected such that, when ultraviolet light having a wavelength of 365 nm and ultraviolet light having a wavelength of 254 nm are simultaneously irradiated, a color difference $\Delta E^*_{ab}$ between the light emitted from the first fluorescent ink 13 and the light emitted from the second fluorescent ink 14 is not more than 10, preferably not more than 3. In general, the color difference $\Delta E^*_{ab}$ of about 3 is a limit of recognition ability of the human eye, i.e., ability of discriminating colors. Thus, when the color difference $\Delta E^*_{ab}$ is not more than 3, it becomes more difficult to discriminate colors by the naked eye.

The composition of the respective constituent elements of the first fluorescent ink 13 and the second fluorescent ink 14 is not limited to the aforementioned composition, and an optimum composition is set according to properties required for the anti-counterfeit medium 10.

Confirmation Method

Next, a method of examining (confirming) whether a valuable paper formed of the anti-counterfeit medium 10 is genuine or not is described with reference to FIGS. 2 and 6A to 6C.

(Case of Irradiating Visible Light)

At first, the anti-counterfeit medium 10 is observed under visible light. In this case, as described above, the substrate 11, the pattern area 20 of the light-emitting image 12 and the background area 25 thereof are respectively viewed to exhibit a white color (see FIG. 2). Thus, under the visible light, the pattern of the pattern area 20 of the light-emitting image 12 does not appear.

(Case of Irradiation of UV-A)

Then, the anti-counterfeit medium 10 when the UV-A is irradiated thereon is observed. As the UV-A to be irradiated, ultraviolet light having a wavelength of 365 nm is used, for example.

Figure 6A:
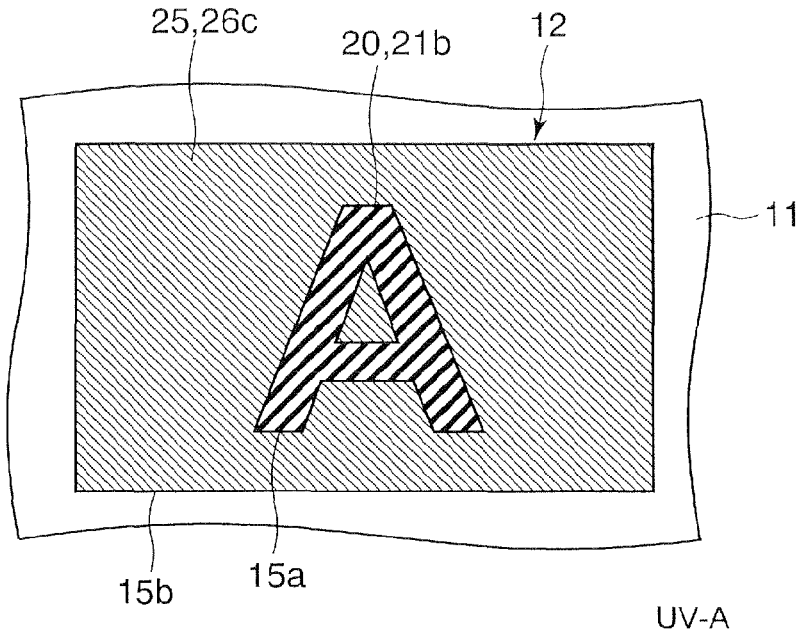
FIG. 6A is a plan view showing the light-emitting image when UV-A is irradiated thereon, in the first embodiment of the present invention.

FIG. 6A is a plan view showing the light-emitting image of the anti-counterfeit medium 10, when the UV-A is irradiated thereon. Since the first fluorescent ink 13 forming the pattern area 20 contains the fluorescent material DE-RG, the first fluorescent ink 13 emits light of green color. Thus, the pattern area 20 is viewed as a green portion 21*b*. On the other hand, since the second fluorescent ink 14 forming the background area 25 contains the fluorescent material DE-GR, the second fluorescent ink 14 emits light of red color. Thus, the background area 25 is viewed as a red portion 26*c*. Namely, when the UV-A is irradiated, the pattern area 20 and the background area 25 are viewed as areas of different colors. Thus, when the UV-A is irradiated, the pattern of the pattern area 20 of the light-emitting image 12 can be viewed.

(Case of Irradiation of UV-C)

Then, the anti-counterfeit medium 10 when the UV-C is irradiated thereon is observed. As the UV-C to be irradiated, ultraviolet light having a wavelength of 254 nm is used, for example.

Figure 6B:
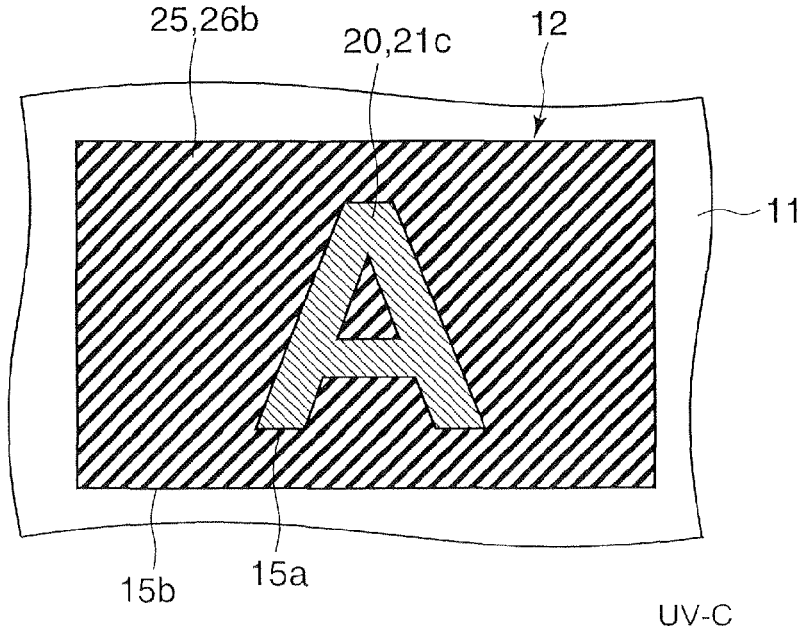
FIG. 6B is a plan view showing the light-emitting image when UV-C is irradiated thereon, in the first embodiment of the present invention.

FIG. 6B is a plan view showing the light-emitting image of the anti-counterfeit medium 10, when the UV-C is irradiated thereon. Since the first fluorescent ink 13 forming the pattern area 20 contains the fluorescent material DE-RG, the first fluorescent ink 13 emits light of red color. Thus, the pattern area 20 is viewed as a red portion 21*c*. On the other hand, since the second fluorescent ink 14 forming the background area 25 contains the fluorescent material DE-GR, the second fluorescent ink 14 emits light of green color. Thus, the background area 25 is viewed as a green portion 26*b*. Namely, when the UV-C is irradiated, the pattern area 20 and the background area 25 are viewed as areas of different colors. Thus, when the UV-C is irradiated, the pattern of the pattern area 20 of the light-emitting image 12 can be viewed.

As described above, the procedure for confirming whether the valuable paper formed of the anti-counterfeit medium 10 is genuine or not is carried out, by examining whether the pattern of the pattern area 20 of the light-emitting image 12 can be viewed or not, when the UV-A or the UV-C is independently irradiated.

In this embodiment, the color of the light emitted from the first fluorescent ink 13 when the UV-A is irradiated and the color of the light emitted from the second fluorescent ink 14 when the UV-C is irradiated are the same with each other. In addition, the color of the light emitted from the first fluorescent ink 13 when the UV-C is irradiated and the color of the light emitted from the second fluorescent ink 14 when the UV-A is irradiated are the same with each other. Thus, when the light irradiated on the light-emitting image 12 composed of the pattern area 20 and the background area 25 is switched between the UV-A and the UV-C, the color of the pattern area 20 and the color of the background area 25 are reversed (switched) from each other.

Herebelow, the "reverse" of the colors is described more specifically. When the UV-A is irradiated, the color of the pattern area 20 formed by using the first fluorescent ink 13 is green, and the background area 25 formed by using the second fluorescent ink 14 is red. Thereafter, when the irradiated light is switched to the UV-C, the color of the pattern area 20 becomes red, which is the color of the background area 25 when the UV-A is irradiated, and the color of the background area 25 becomes green, which is the color of the pattern area 20 of the pattern area 20 when the UV-A is irradiated. The switching of colors is the above-described "reverse" of the colors.

In this manner, by examining whether the color of the pattern area 20 and the color of the background area 25 are reversed from each other, when the irradiated light is switched from the UV-A to the UV-C and vice versa, reliability in confirmation of whether the valuable paper formed of the anti-counterfeit medium 10 is genuine or not can be further improved.

(Case of Simultaneous Irradiation of UV-A and UV-C)

Then, the anti-counterfeit medium 10 when the UV-A and the UV-C are simultaneously irradiated thereon is observed.

Figure 6C:
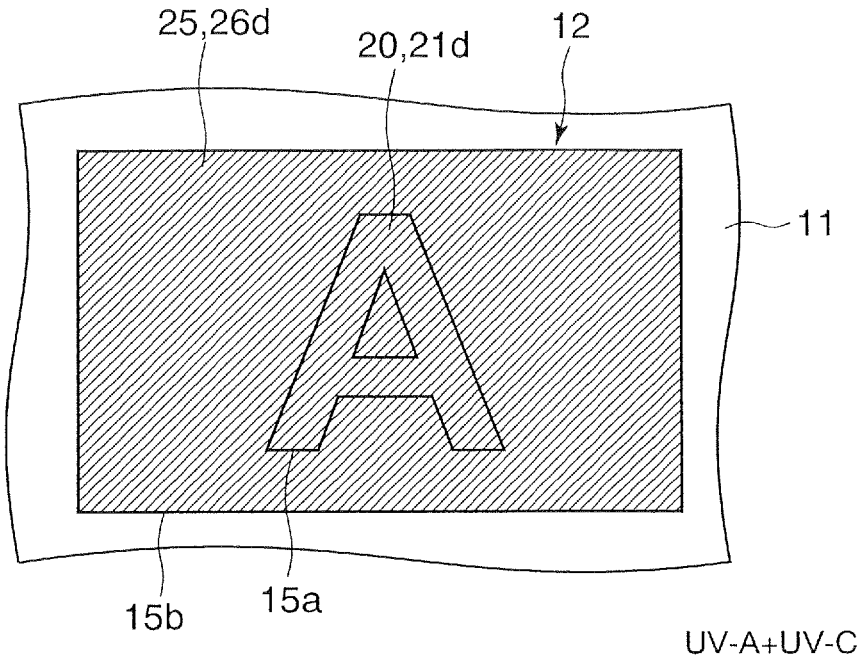
FIG. 6C is a plan view showing the light-emitting image when the UV-A and the UV-C are simultaneously irradiated thereon, in the first embodiment of the present invention.

FIG. 6C is a plan view showing the light-emitting image 12 of the anti-counterfeit medium 10 when the UV-A and the UV-C are simultaneously irradiated thereon. In this case, the first fluorescent ink 13 emits light of yellow color which is an additive mixture of the light of green color upon irradiation of the UV-A and the light of red color upon irradiation of the UV-C. On the other hand, the second fluorescent ink 14 emits light of yellow color which is an additive mixture of the light of red color upon irradiation of the UV-A and the light of green color upon irradiation of the UV-C. Thus, as shown in FIG. 6C, the pattern area 20 is viewed as a yellow portion 21*d*, while the background area 25 is also viewed as a yellow portion 26*d*. Namely, when the UV-A and the UV-C are simultaneously irradiated, the pattern area 20 and the background area 25 are viewed as areas of the same color. Thus, when the UV-A and the UV-C are simultaneously irradiated, the pattern of the pattern area 20 of the light-emitting image 12 cannot be viewed.

When the visible light, the UV-A or UV-C is irradiated, and when the UV-A and the UV-C are simultaneously irradiated, by examining whether the colors of the pattern area 20 and the background area 25 change in the manner as described above, whether the valuable paper formed of the anti-counterfeit medium 10 is genuine or not can be confirmed.

According to this embodiment, the anti-counterfeit medium 10 includes the substrate 11, the pattern area 20 formed on the substrate 11 by using the first fluorescent ink 13 containing the first fluorescent material, and the background area 25 formed on the substrate 11 by using the second fluorescent ink 14 containing the second fluorescent material, the background area 25 being formed so as to be adjacent to the pattern area 20. When the UV-A is irradiated, the first fluorescent material of the first fluorescent ink 13 and the second fluorescent material of the second fluorescent ink 14 emit light of colors that are viewed as different colors from each other. In addition, when the UV-C is irradiated, the first fluorescent material of the first fluorescent ink 13 and the second fluorescent material of the second fluorescent ink 14 emit colors that are viewed as different colors from each other, the colors being different from the colors that are viewed when the UV-A is irradiated. When the UV-A and the UV-C are simultaneously irradiated, the first fluorescent material of the first fluorescent ink 13 and the second fluorescent material of the second fluorescent ink 14 emit light of a color that is viewed as the same color (yellow color) with each other. Thus, when the UV-A or the UV-C is independently irradiated, the pattern area 20 and the background area 25 can be discriminated from each other. Meanwhile, when the UV-A and the UV-C are simultaneously irradiated, the pattern area 20 and the background area 25 cannot be discriminated from each other. That is to say, the pattern of the pattern area 20 can be viewed when the UV-A or the UV-C is independently irradiated, and cannot be viewed when the UV-A and the UV-C are simultaneously irradiated.

Namely, according to this embodiment, it is possible to change the appearance of the light-emitting image 12 composed of the pattern area 20 and the background area 25 when the UV-A is irradiated, when the UV-C is irradiated, and when the UV-A and the UV-C are simultaneously irradiated, respectively.

In addition, according to this embodiment, by suitably selecting the first fluorescent material of the first fluorescent ink and the second fluorescent material of the second fluorescent ink 14, it is possible that the pattern of the pattern area 20 does not appear when the UV-A and the UV-C are simultaneously irradiated.

According to this embodiment, an acceptance condition for judging that a valuable paper to be examined is genuine can be made severe. Thus, reliability in confirmation of whether the valuable paper formed of the anti-counterfeit medium 10 is genuine or not can be improved. Further, forging of the anti-counterfeit medium 10 can be made more difficult.

In addition, according to this embodiment, the first fluorescent material of the first fluorescent ink 13 emits light of green color (first color) when the UV-A is irradiated, and emits light of red color (second color) when the UV-C is irradiated. Meanwhile, the second fluorescent material of the second fluorescent ink 14 emits light of red color (second color) or a color that is viewed as the same color with the red color (second color) when the UV-A is irradiated, and emits light of green color (first color) or a color that is viewed as the same color with the green color (first color) when the UV-C is irradiated. Namely, when the irradiated light is switched between the UV-A and the UV-C, the color of the first fluorescent material and the color of the second fluorescent material are reversed (switched) from each other. Thus, an acceptance condition for judging that a valuable paper to be examined is genuine can be made more severe. Therefore, reliability in confirmation of whether the valuable paper formed of the anti-counterfeit medium 10 is genuine or not can be further improved. Further, forging of the anti-counterfeit medium 10 can be made more difficult.

First Modification Example

In this embodiment, there is described the example in which the pattern area 20 of the light-emitting image 12 and the background area 25 thereof are formed on the substrate 11 by solid-printing thereon the first fluorescent ink 13 containing the first fluorescent material and the second fluorescent ink 14 containing the second fluorescent material. However, not limited thereto, the pattern area 20 and the background area 25 may be formed by printing, on the substrate 11, the first fluorescent ink 13 containing the first fluorescent material and the second fluorescent ink 14 containing the second fluorescent material in an identical predetermined pattern. Herebelow, the first fluorescent ink 13 and the second fluorescent ink 14 are printed in a striped pattern on the substrate 11 with reference to FIGS. 7 to 9C.

Figure 7:
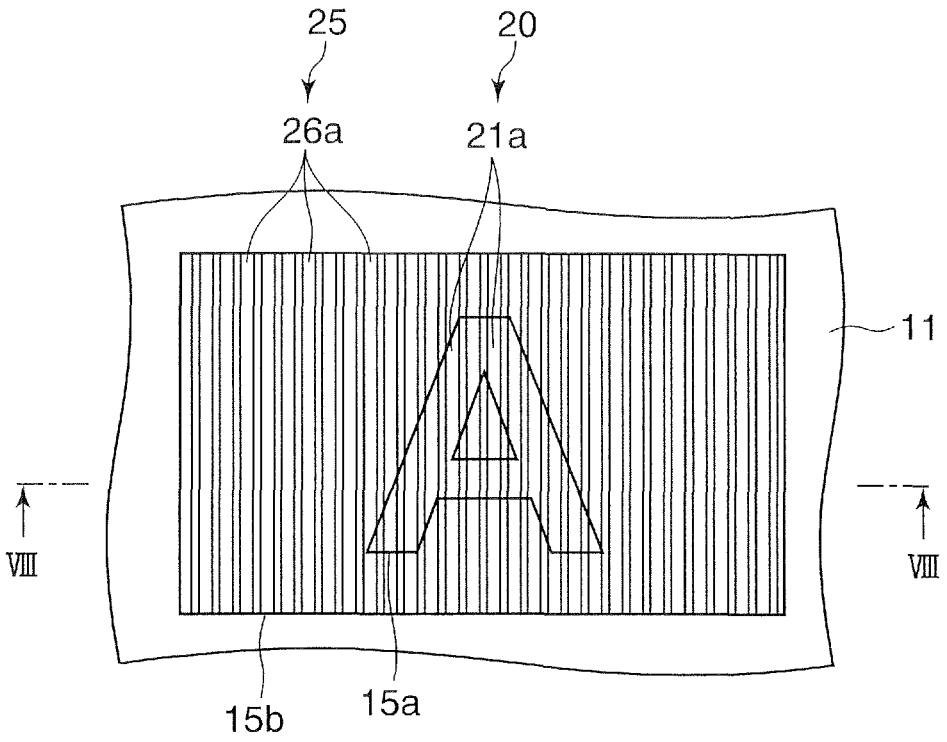
FIG. 7 is a plan view showing the light-emitting image of the anti-counterfeit medium in a first modification example of the first embodiment of the present invention.
Figure 8:
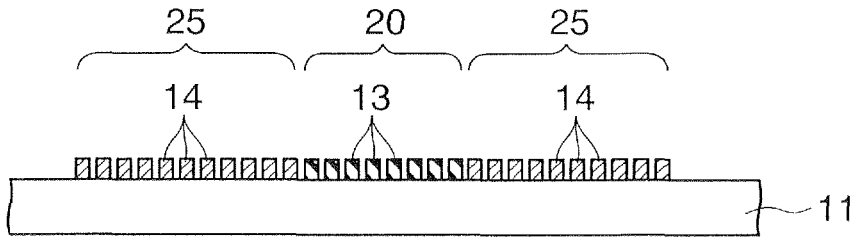
FIG. 8 is a sectional view taken along a line VIII-VIII of the light-emitting image shown in FIG. 7.

FIG. 7 is a plan view showing the light-emitting image 12 of the anti-counterfeit medium 10 under visible light, in this modification example. FIG. 8 is a sectional view taken along a line VIII-VIII of the light-emitting image 12 shown in FIG. 7. As shown in FIGS. 7 and 8, in this modification example, the pattern area 20 and the background area 25 are formed by printing, on the substrate 11, the first fluorescent ink 13 and the second fluorescent ink 14 in a striped pattern.

Next, a method of examining whether a valuable paper formed of the anti-counterfeit medium 10 is genuine or not in this modification example is described with reference to FIGS. 7 and 9A to 9C.

(Case of Irradiation of Visible Light)

Under visible light, as shown in FIG. 7, the pattern area 20 and the background area 25 are formed of white portions 21*a* and 26*a* that are positioned in a striped pattern. Thus, under the visible light, the pattern of the pattern area 20 of the light-emitting image 12 does not appear.

(Case of Irradiation of UV-A)

Figure 9A:
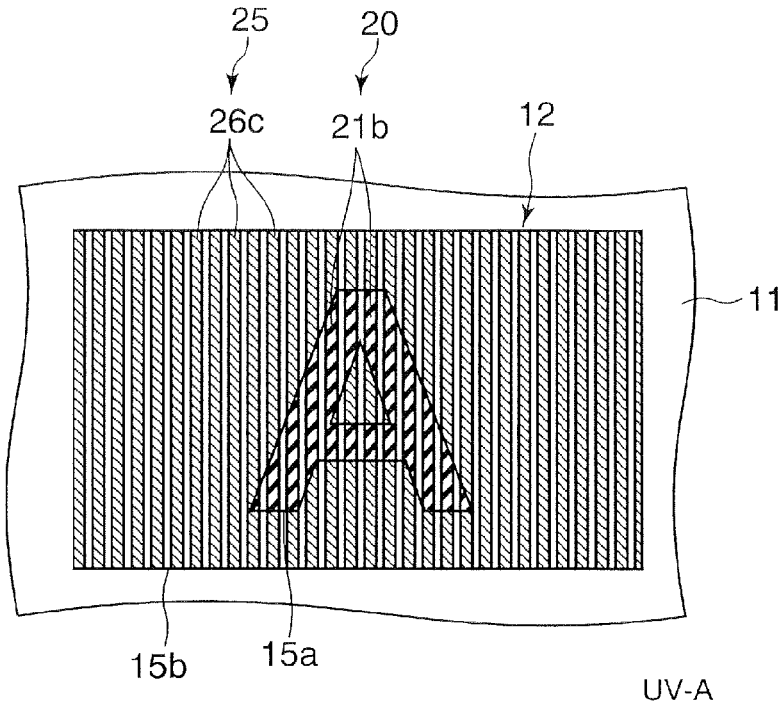
FIG. 9A is a plan view showing the light-emitting image when the UV-A is irradiated thereon, in the first modification example of the first embodiment of the present invention.

FIG. 9A is a plan view showing the light-emitting image 12 of the anti-counterfeit medium 10 when the UV-A is irradiated thereon. The pattern area 20 and the background area 25 are respectively formed of green portions 21*b* and red portions 26*c* that are positioned in a striped pattern. Thus, when the UV-A is irradiated, the pattern of the pattern area 20 of the light-emitting image 12 can be viewed.

(Case of Irradiation of UV-C)

Figure 9B:
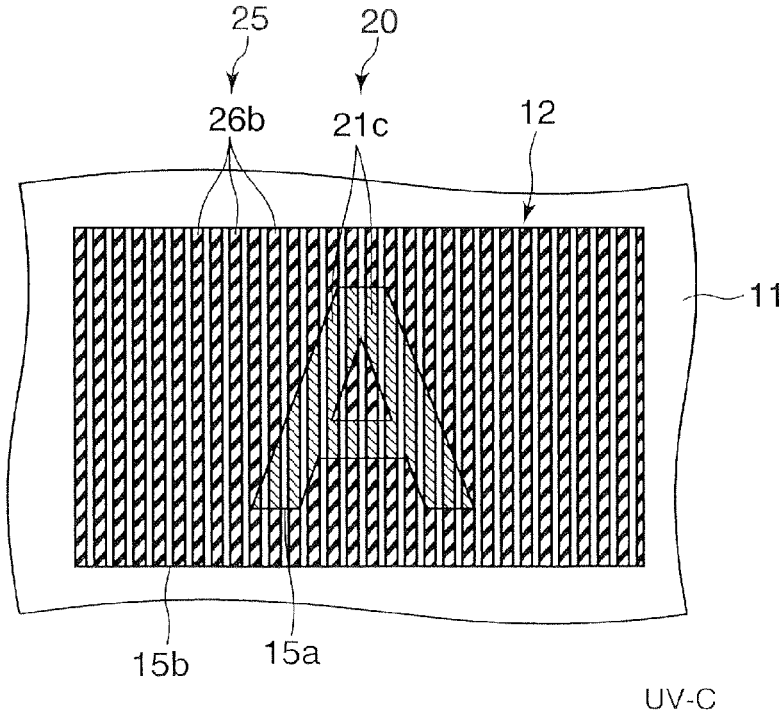
FIG. 9B is a plan view showing the light-emitting image when the UV-C is irradiated thereon, in the first modification example of the first embodiment of the present invention.

FIG. 9B is a plan view showing the light-emitting image 12 of the anti-counterfeit medium 10 when the UV-C is irradiated thereon. The pattern area 20 and the background area 25 are respectively formed of red portions 21*c* and green portions 26*b* that are positioned in a striped pattern. Thus, when the UV-C is irradiated, the pattern of the pattern area 20 of the light-emitting image 12 can be viewed.

(Case of Simultaneous Irradiation of UV-A and UV-C)

Figure 9C:
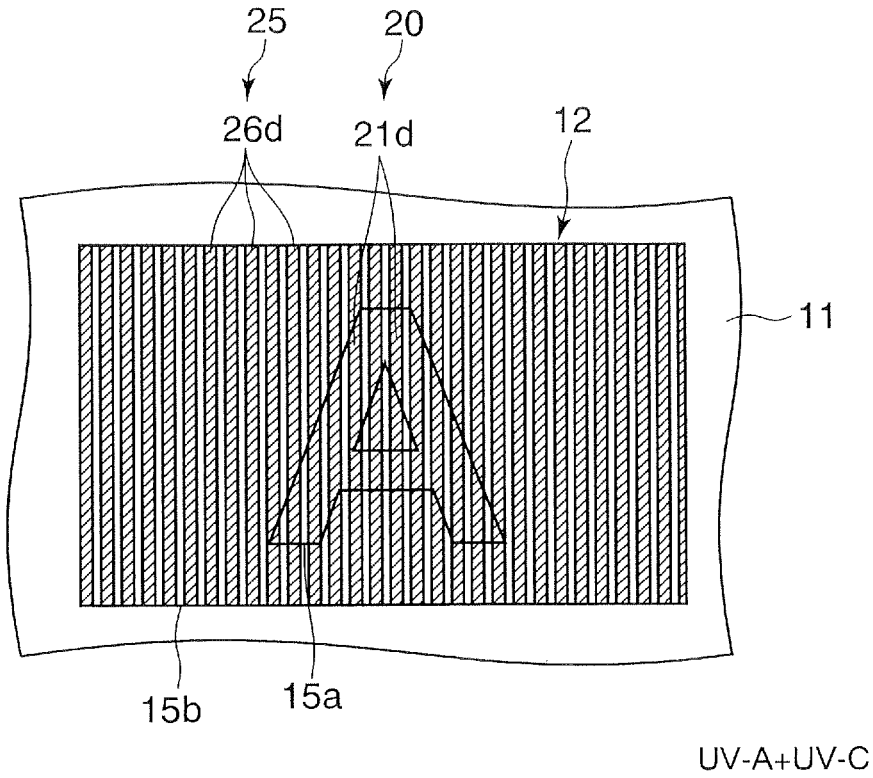
FIG. 9C is a plan view showing the light-emitting image when the UV-A and the UV-C are simultaneously irradiated thereon, in the first modification example of the first embodiment of the present invention.

FIG. 9C is a plan view showing the light-emitting image 12 of the anti-counterfeit medium 10 when the UV-A and the UV-C are simultaneously irradiated thereon. The pattern area 20 and the background area 25 are respectively formed of yellow portions 21*d* and yellow portions 26*d* that are positioned in a striped pattern. Thus, when the UV-A and the UV-C are simultaneously irradiated, the pattern of the pattern area 20 of the light-emitting image 12 does not appear.

In this modification example, as compared with a case in which the first fluorescent ink 13 and the second fluorescent ink 14 are sold-printed on the substrate 11, a part where the yellow portion 21*d* of the pattern area 20 and the yellow portion 26*d* of the background area 25 are in contact with each other is smaller. Thus, even when there exits light that is irregularly reflected or inflected at the part where yellow portion 21*b* and the yellow portion 26*d* are in contact with each other, there is less possibility that a boundary between the yellow portion 21*d* and the yellow portion 26*d* can be viewed because of the existence of such light.

In this modification example, there is described the example in which the first fluorescent ink 13 and the second fluorescent ink 14 are printed on the substrate 11 in a striped pattern. However, not limited thereto, the first fluorescent ink 13 and the second fluorescent ink 14 can be printed on the substrate 11 in various other patterns.

For example, the first fluorescent ink 13 and the second fluorescent ink 14 may be printed on the substrate 11 in a dotted pattern. A dot percentage at this time is not particularly limited. Any dot percentage is suitably set depending on properties required for the anti-counterfeit medium 10.

Second Modification Example

In this embodiment, there is described the example in which an ink containing the fluorescent material DE-RG is used as the first fluorescent ink 13 and an ink containing the fluorescent material DE-GR is used as the second fluorescent ink 14. Namely, there is described the example in which inks of a combination_1 shown in the below Table 1 are used. However, not limited thereto, inks of a combination_2 or inks of combination_3 in Table 1 may be used as the first fluorescent ink 13 and the second fluorescent ink 14. Similarly to the case of the combination_1, in the case of the combination_2 or the combination_3, the first fluorescent ink 13 and the second fluorescent ink 14 are inks which emit light of colors that are viewed as different colors when the UV-A or the UV-C is independently irradiated, and emit light of colors that are viewed as the same color when the UV-A and the UV-C are simultaneously irradiated. Therefore, reliability in confirmation of whether the valuable paper formed of the anti-counterfeit medium 10 is genuine or not can be further improved. Further, forging of the anti-counterfeit medium 10 can be made more difficult.

In Table 1, the colors in the "UV-A" column or in the "UV-C" column respectively means color of light emitted from the first fluorescent ink 13 and the second fluorescent ink 14 when the UV-A or the UV-C is irradiated. In the column of "fluorescent material" describing "DE-$X_1X_2$", $X_1$ means a color of light emitted when the UV-C is irradiated, and $X_2$ means a color of light emitted when the UV-A is irradiated. For example, the fluorescent material DE-RG is a fluorescent material that emits light of red color upon irradiation of UV-C and emits light of green color upon irradiation of UV-A. The names described in the "fluorescent material" column represent product names of Nemoto & Co., Ltd.

TABLE 1

| Combination | | UV-A | UV-C | UV-A + UV-C | Fluorescent Material |
|---|---|---|---|---|---|
| 1 | First Fluorescent Ink | Green Color | Red Color | Yellow Color | DE-RG |
| | Second Fluorescent Ink | Red Color | Green Color | Yellow Color | DE-GR |
| 2 | First Fluorescent Ink | Blue Color | Red Color | Purplish Red Color | DE-RB |
| | Second Fluorescent Ink | Red Color | Blue Color | Purplish Red Color | DE-BR |
| 3 | First Fluorescent Ink | Green Color | Blue Color | Aeruginous Color | DE-BG |
| | Second Fluorescent Ink | Blue Color | Green Color | Aeruginous Color | DE-GB |

Third Modification Example

In this embodiment, there is described the example in which the first fluorescent material of the first fluorescent ink 13 emits light of green color (first color) upon irradiation of the UV-A, and emits light of red color (second color) upon irradiation of the UV-C, and the second fluorescent material of the second fluorescent ink 14 emits light of red color (second color) or light of a color that is viewed as the same color as the red color (second color) upon irradiation of UV-A, and emits light of green color (first color) or light of a color that is viewed as the same color as the green color (first color). Namely, when the irradiated light is switched between the UV-A and the UV-C, the color of the first fluorescent material and the color of the second fluorescent material are reversed from each other.

Figure 10:
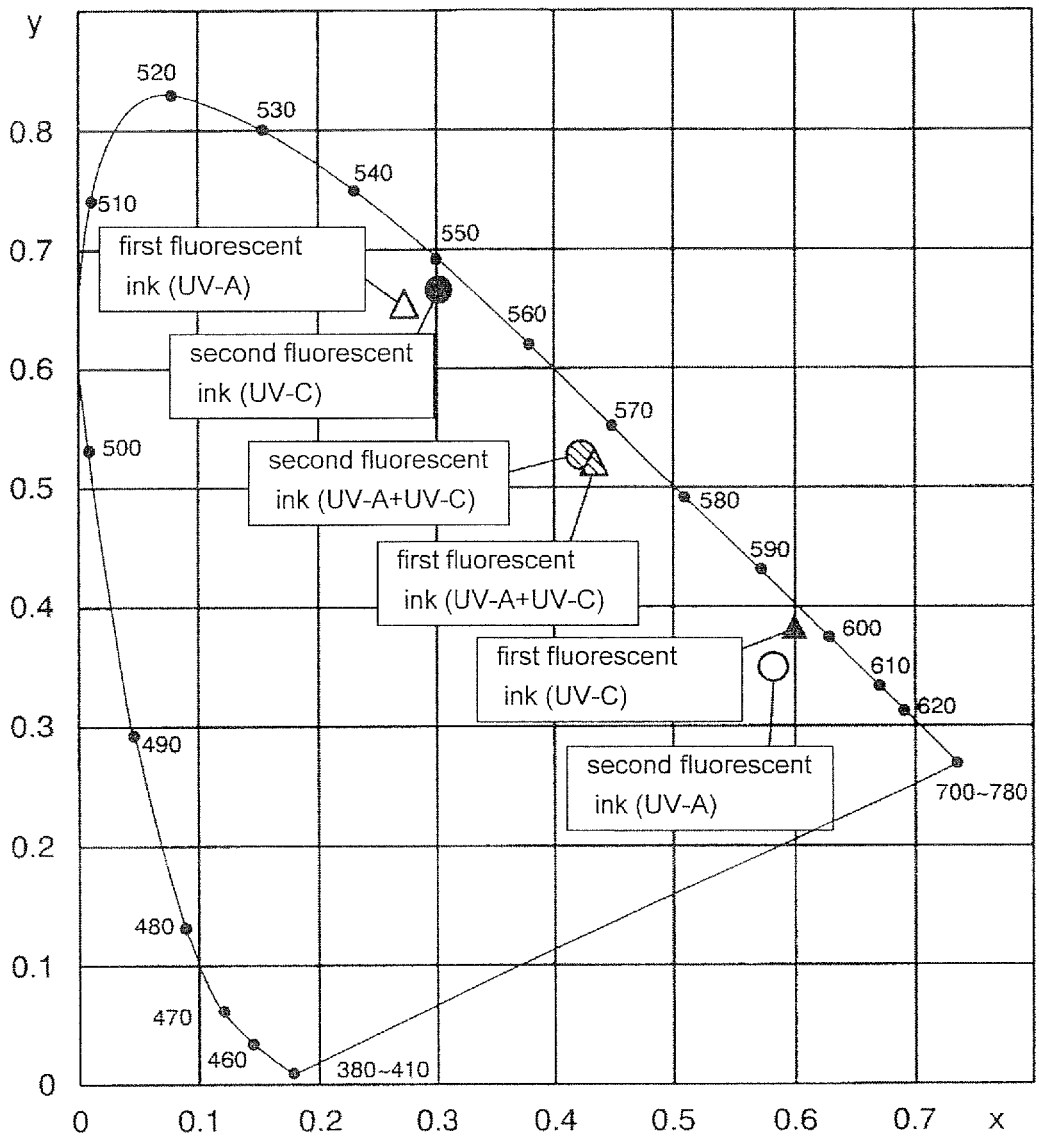
FIG. 10 is an xy chromaticity diagram showing chromaticities of fluorescent light emitted from a first fluorescent ink and chromaticities of fluorescent light emitted from a second fluorescent ink, in a third modification example of the first embodiment of the present invention.

However, not limited thereto, as shown in FIG. 10, the color of the light emitted from the first fluorescent ink 13 upon irradiation of the UV-A and the color of the light emitted from the second fluorescent ink 14 upon irradiation of the UV-C may be different from each other. In addition, the color of the light emitted from the first fluorescent ink 13 upon irradiation of the UV-C and the color of the light emitted from the second fluorescent ink 14 upon irradiation of the UV-A may be different from each other.

That is to say, it is sufficient that the first fluorescent material and the second fluorescent material are selected such that, at least, the first fluorescent ink 13 and the second fluorescent ink 14 emit light of colors that are viewed as the same color with each other when the UV-A and the UV-C are simultaneously irradiated, and that the color of the inks 13 and 14 when the UV-A is irradiated and the color of the inks 13 and 14 when the UV-C is irradiated are different from each other. Therefore, it is possible to change the appearance of the light-emitting image 12 composed of the pattern area 20 and the background area 25 when the UV-A is irradiated, when the UV-C is irradiated, and when the UV-A and the UV-C are simultaneously irradiated, respectively. Thus, an acceptance condition for judging that a valuable paper to be examined is genuine can be made more severe. Therefore, reliability in confirmation of whether the valuable paper formed of the anti-counterfeit medium 10 is genuine or not can be further improved. Further, forging of the anti-counterfeit medium 10 can be made more difficult.

Accordingly, it is not inevitably necessary that the color of the first fluorescent material and the color of the fluorescent material are in the reverse relationship, when the UV-A and the UV-C are switched each other.

Fourth Modification Example

In this embodiment, there is described the example in which white polyethylene terephthalate is used as a material of the substrate 11. However, the color of the substrate 11 is not limited to a white color. The color of the substrate 11 may be a color that is viewed as the same color as the colors of the first fluorescent ink 13 and the second fluorescent ink 14 (colors of the first fluorescent material and the second fluorescent material), when the UV-A and the UV-C are simultaneously irradiated.

Figure 11:
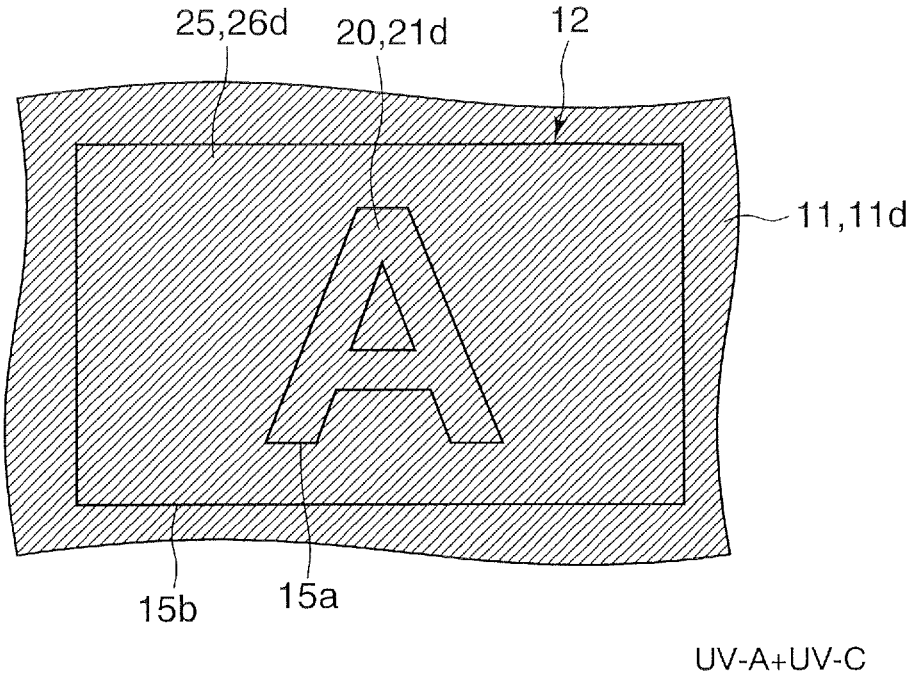
FIG. 11 is a plan view showing the light-emitting image when the UV-A and the UV-C are simultaneously irradiated thereon, in a fourth modification example of the first embodiment of the present invention.

FIG. 11 is a plan view showing the light-emitting image 12 when the UV-A and the UV-C are simultaneously irradiated thereon. As described above, when the UV-A and the UV-C are simultaneously irradiated, the pattern area 20 and the background area 25 are viewed as the yellow portions 21*b* and 26*d*. In this modification example, the substrate 11 is formed of a material that reflects light of yellow color. Thus, when not only the UV-A and the UV-C but also the visible light exits, the substrate 11 is viewed as a yellow portion 11*d*. As a result, the pattern area 20, the background area 25 and the substrate 11 are viewed to exhibit the same color with each other. By adding, to the acceptance reference, the condition in which the color of the substrate 11 is the same as the colors of the pattern area 20 and the background area 25, reliability in confirmation of whether the valuable paper formed of the anti-counterfeit medium 10 is genuine or not can be further improved. Further, forging of the anti-counterfeit medium 10 can be made more difficult.

In this modification example, there is described the example in which the substrate 11 is viewed as the yellow portion 11*d* when the visible light is irradiated. However, not limited thereto, the color of the substrate 11 may be variously set such that the color of the substrate 11 is the same as the colors of the first fluorescent ink 13 and the second fluorescent ink 14 when the UV-A and the UV-C are simultaneously irradiated. For example, when the inks 13 and 14 in the combination_2 of the above Table 1 are used, the color of the substrate 11 is set as a purplish red color. Alternatively, when the inks 13 and 14 in the combination_3 of the above Table 1 are used, the color of the substrate 11 is set as a aeruginous color.

Other Modification Examples

In this embodiment, there is described the example in which the pattern area 20 is formed by using the first fluorescent ink 13 and the background area 25 is formed by using the second fluorescent ink 14. However, not limited thereto, the pattern area 20 may be formed by using the second fluorescent ink 14 and the background area 25 may be formed by using the first fluorescent ink 13. Also in this case, the pattern of the pattern area 20 can be viewed when the UV-A or the UV-C is independently irradiated, and cannot be viewed when the UV-A and the UV-C are simultaneously irradiated. Thus, forging of the anti-counterfeit medium 10 is made difficult.

In this embodiment, there is described the example in which inks having excitation properties with respect to the UV-A and the UV-C are used as the first fluorescent ink 13 and the second fluorescent ink 14. However, not limited thereto, inks having excitation properties with respect to UV-B or infrared light may be used as the first fluorescent ink 13 and the second fluorescent ink 14. Namely, invisible light within any given wavelength range may be used as the "invisible light within a first wavelength range" and the "invisible light within a second wavelength range" in the present invention.

In addition, in this embodiment, there is described the example in which the background area 25 is formed to surround the pattern area 20. However, not limited thereto, it is sufficient that at least a part of the background area 25 is in contact with the pattern area 20.

In addition, in this embodiment, there is described the example in which the pattern area 20 and the background area 25 are respectively viewed to exhibit a white color. However, not limited thereto, it is sufficient that at least the pattern area 20 and the background area 25 are viewed as areas of the same color under the visible light.

In addition, in this embodiment, there is described the example in which the color of the light emitted from the first fluorescent ink 13 and the second fluorescent ink 14 is one of the blue color, the red color or the green color, when the invisible light within the first wavelength range or the invisible light within the second wavelength range is independently irradiated. However, not limited thereto, as the inks 13 and 14, there may be used inks of various combinations, which are viewed as different colors when the invisible light within the first wavelength range or the invisible light within the second wavelength range is independently irradiated, and viewed as the same color when the invisible light within the first wavelength range and the invisible light within the second wavelength range are simultaneously irradiated.

In addition, in this embodiment, there is described the example in which the light-emitting medium of the present invention is used as the anti-counterfeit medium constituting a valuable paper. However, not limited thereto, the light-emitting medium of the present invention can be used in various other applications. For example, the light-emitting medium of the present invention is applied to, e.g., a toy. Also in this case, since the light-emitting image composed of the pattern area and the background area can be recognized when the invisible light within the first wavelength range or the invisible light within the second wavelength range is independently irradiated, and cannot be recognized when the invisible light within the first wavelength range and the invisible light within the second wavelength range are simultaneously irradiated, various functions or qualities can be given to the toy or the like.

Second Embodiment

Next, a second embodiment of the present invention is described with reference to FIGS. 12A to 13.

In the aforementioned first embodiment and the modification examples thereof, there is described the example in which when the invisible light within the first wavelength range and the invisible light within the second wavelength range are simultaneously irradiated, the first fluorescent material of the first fluorescent ink 13 and the second fluorescent material of the second fluorescent ink 14 emit light of colors that are viewed as the same color with each other. However, not limited thereto, when the invisible light within the first wavelength range and the invisible light within the second wavelength range are simultaneously irradiated, e.g., when the UV-A and the UV-C are simultaneously irradiated, the first fluorescent material of the first fluorescent ink 13 and the second fluorescent material of the second fluorescent ink 14 may emit light of colors that are viewed as different colors from each other. Herebelow, such an embodiment is described.

Figure 12A:
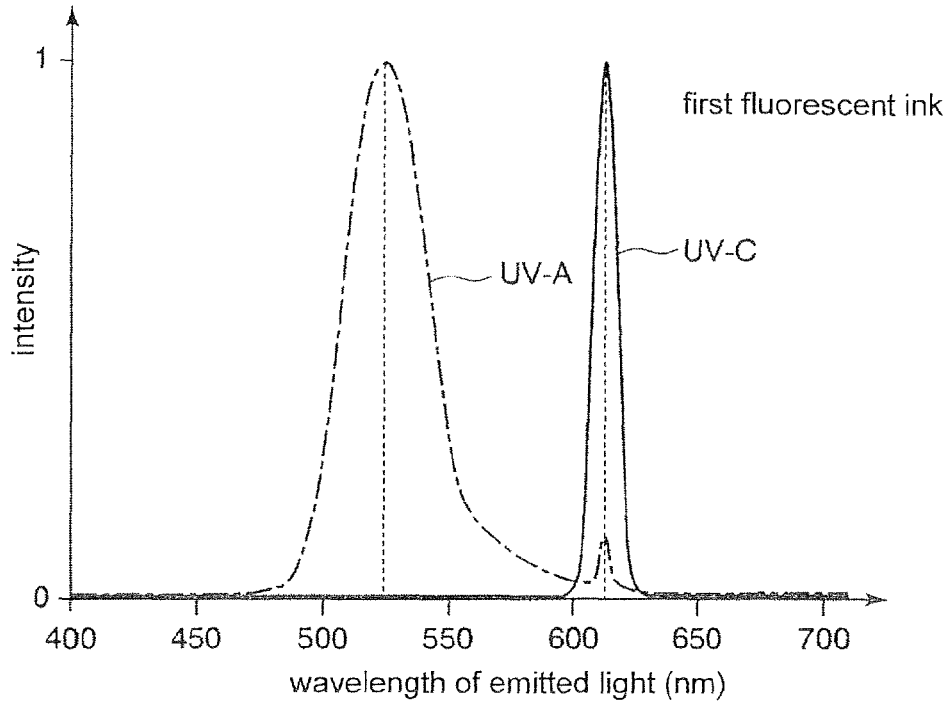
FIG. 12A is a view showing a fluorescence emission spectrum of a first fluorescent ink, in a second embodiment of the present invention.
Figure 12B:
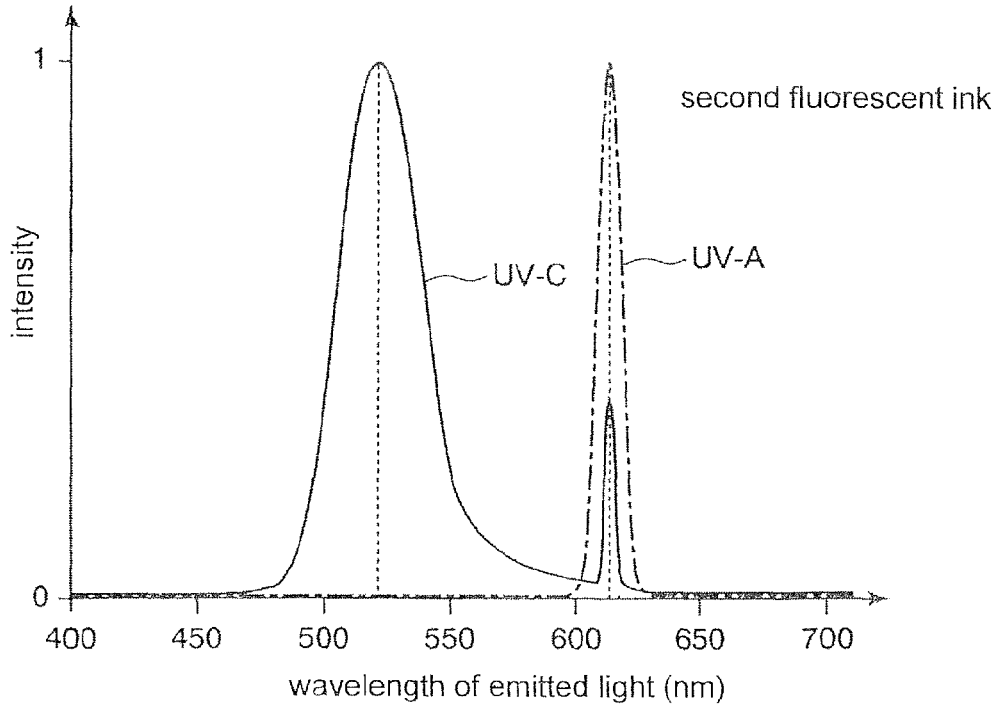
FIG. 12B is a view showing a fluorescence emission spectrum of a second fluorescent ink, in the second embodiment of the present invention.
Figure 13:
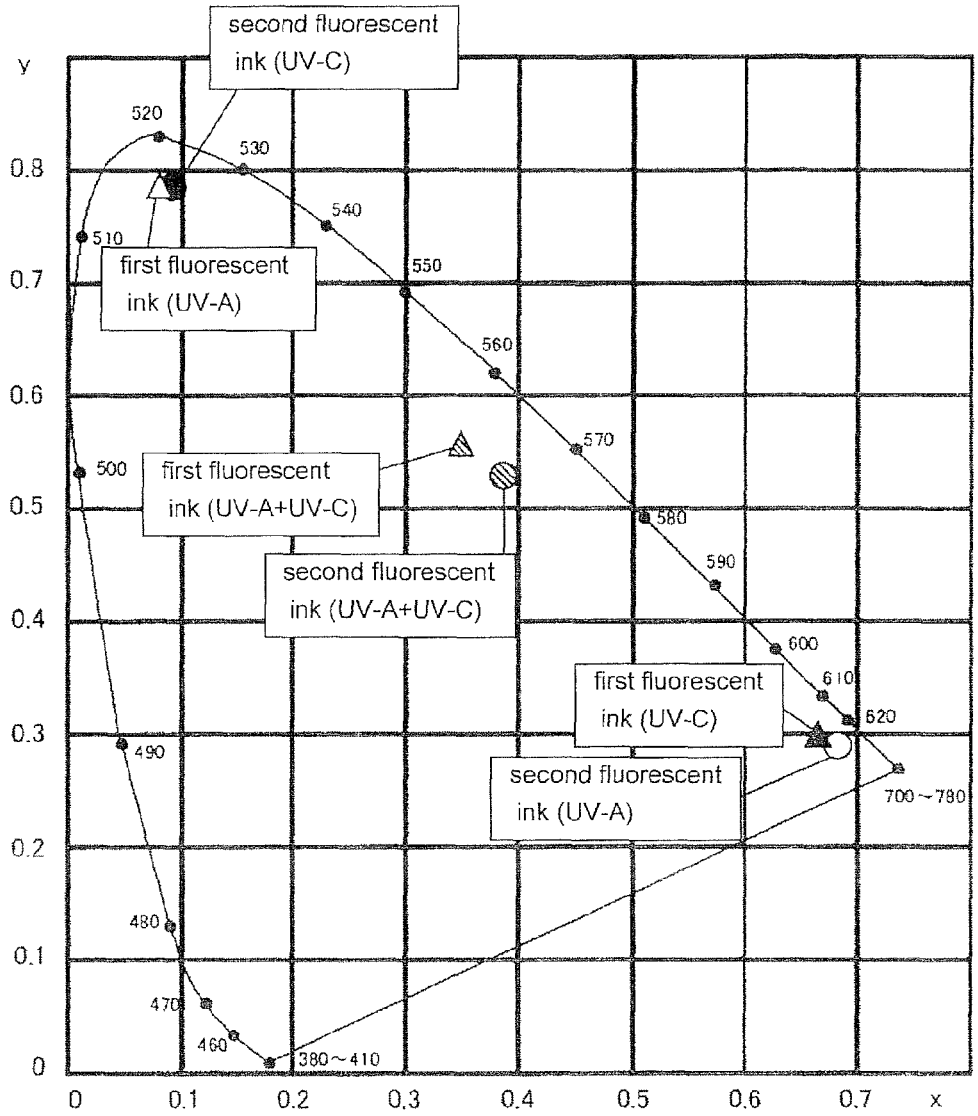
FIG. 13 is an xy chromaticity diagram showing chromaticities of fluorescent light emitted from the first fluorescent ink and chromaticities of light emitted from the second fluorescent ink, in the second embodiment of the present invention.

The embodiment shown in FIGS. 12A to 13 differs from the aforementioned first embodiment and the modification examples thereof only in that there are used a first fluorescent material of a first fluorescent ink 13 and a second fluorescent material of a second fluorescent ink 14 that emit light of colors that are viewed as different colors from each other, when the UV-A and the UV-C are simultaneously irradiated. The other structures are substantially the same as the aforementioned first embodiment and the modification examples.

Fluorescent Inks

A first fluorescent ink 13 and a second fluorescent ink 14 are described with reference to FIGS. 12A to 13. FIG. 12A is a view showing a fluorescence emission spectrum of the first fluorescent ink 13, and FIG. 12B is a view showing a fluorescence emission spectrum of the second fluorescent ink 14. FIG. 13 is an xy chromaticity diagram showing, by means of an XYZ colorimetric system, chromaticities of light emitted from the first fluorescent ink 13 and chromaticities of light emitted from the second fluorescent ink 14, when light within specific wavelength range is irradiated.

(First Fluorescent Ink)

As shown in FIG. 12A, the first fluorescent ink 13 emits light of green color (first color) having a peak wavelength $\lambda_{1A}$ of about 514 nm upon irradiation of the UV-A, and emits light of red color (second color) having a peak wavelength $\lambda_{1C}$ of about 620 nm upon irradiation of the UV-C. For example, a fluorescent material DCP No. 4a (manufactured by Nemoto & Co., Ltd.) is used as a dichromic fluorescent material (first fluorescent material) for such a first fluorescent ink 13.

(Second Fluorescent Ink)

As shown in FIG. 12B, upon irradiation of the UV-A, the second fluorescent ink 14 emits light having a peak wavelength $\lambda_{2A}$ of about 627 nm, which is light of red color (second color) or light of a color that is viewed as the same color as the red color (second color). Upon irradiation of the UV-C, the second fluorescent ink 14 emits light having a peak wavelength $\lambda_{2c}$ of about 525 nm, which is light of green color (first color) or light of a color that is viewed as the same color as the green color (first color). For example, a fluorescent material DCP No. 8 (manufactured by Nemoto & Co., Ltd.) is used as a dichromic fluorescent material (second fluorescent material) for such a second fluorescent ink 14.

Next, the chromaticities of light emitted from the first fluorescent ink 13 and chromaticities of light emitted from the second fluorescent ink 14, and an operation obtained based on the fluorescent light having these chromaticities are described with reference to FIG. 13.

As shown in FIG. 13, the chromaticity of the light emitted from the first fluorescent light 13 upon independent irradiation of the UV-A and the chromaticity of the light emitted from the second fluorescent light 14 upon independent irradiation of the UV-A are distant from each other. The chromaticity of the light emitted from the first fluorescent light 13 upon independent irradiation of the UV-C and the chromaticity of the light emitted from the second fluorescent light 14 upon independent irradiation of the UV-C are distant from each other. The chromaticity of the light emitted from the first fluorescent light 13 upon simultaneous irradiation of the UV-A and the UV-C and the chromaticity of the light emitted from the second fluorescent light 14 upon simultaneous irradiation of the UV-A and the UV-C are distant from each other. Namely, the color of the light emitted from the first fluorescent ink 13 and the color of the light emitted from the second fluorescent ink 14 are different from each other, when the UV-A is independently irradiated, when the UV-C is independently irradiated, and when the UV-A and the UV-C are simultaneously irradiated, respectively. Thus, the pattern of the pattern area 20 of the light-emitting image 12 can be viewed, when the UV-A is independently irradiated, when the UV-C is independently irradiated, and when the UV-A and the UV-C are simultaneously irradiated, respectively.

According to this embodiment, not only when the UV-A or the UV-C are independently irradiated on the anti-counterfeit medium 10 but also when the UV-A and the UV-C are simultaneously irradiated on the anti-counterfeit medium 10, the pattern of the pattern area of the light-emitting image 12 can be viewed. Thus, according to this embodiment, the pattern of the pattern area 20 of the light-emitting image 12 can be confirmed by three color combinations. Therefore, reliability in confirmation of whether the valuable paper formed of the anti-counterfeit medium 10 is genuine or not can be further improved. Further, forging of the anti-counterfeit medium 10 can be made more difficult.

In addition, in this embodiment, as shown in FIG. 13, in the xy chromaticity diagram, the chromaticity of the light emitted from the first fluorescent ink 13 upon irradiation of the UV-A and the chromaticity of the light emitted from the second fluorescent ink 14 upon irradiation of the UV-C are close to each other. Namely, similarly to the aforementioned first embodiment shown in FIG. 5, the color of the light emitted from the first fluorescent ink 13 upon irradiation of the UV-A and the color of the light emitted from the second fluorescent ink 14 upon irradiation of the UV-C are the same with each other.

In addition, as shown in FIG. 13, the chromaticity of the light emitted from the first fluorescent ink 13 upon irradiation of the UV-C and the chromaticity of the light emitted from the second fluorescent ink 14 upon irradiation of the UV-A are close to each other. Namely, similarly to the aforementioned first embodiment shown in FIG. 5, the color of the light emitted from the first fluorescent ink 13 upon irradiation of the UV-C and the color of the light emitted from the second fluorescent ink 14 upon irradiation of the UV-A are the same with each other.

Thus, also in this embodiment, similarly to the aforementioned first embodiment shown in FIGS. 6A and 6B, when the light irradiated on the light-emitting image 12 composed of the pattern area 20 and the background area 25 is switched between the UV-A and the UV-C, the color of the pattern area 20 and the color of the background area 25 are reversed (switched) from each other. Therefore, by examining whether the color of the pattern area 20 and the color of the background area 25 are reversed from each other, when the irradiated light is switched from the UV-A to the UV-C and vice versa, reliability in confirmation of whether the valuable paper formed of the anti-counterfeit medium 10 is genuine or not can be further improved.

In this embodiment, there is described the example in which the fluorescent material DCP No. 4a is used as the first fluorescent material of the first fluorescent ink 13, and the fluorescent material DCP No. 8 is used as the second fluorescent material of the second fluorescent ink 14. However, not limited thereto, as long as the color of the first fluorescent ink 13 and the color of the second fluorescent ink 14 are viewed as different colors from each other, when the UV-A is independently irradiated, when the UV-C is independently irradiated, and when the UV-A and the UV-C are simultaneously irradiated, respectively, and as long as the color of the first fluorescent ink 13 and the color of the second fluorescent ink 14 are reversed from each other when the irradiated light is switched between the UV-A and the UV-C, various other fluorescent materials may be used as the first fluorescent material of the first fluorescent ink 13 and the second fluorescent material of the second fluorescent ink 14.

Modification Example

In this embodiment, there is described the example in which the color of the light emitted from the first fluorescent material and the color of the light emitted from the second fluorescent material are reversed from each other, when the irradiated light is switched between the UV-A and the UV-C. However, not limited thereto, similarly to the third modification example of the aforementioned first embodiment shown in FIG. 10, the color of the light emitted from the first fluorescent material upon irradiation of the UV-A and the color of the light emitted from the second fluorescent material upon irradiation of the UV-C may be different from each other. In addition, the color of the light emitted from the first fluorescent material upon irradiation of the UV-C and the color of the light emitted from the second fluorescent material upon irradiation of the UV-A may be different from each other. Herebelow, such a modification example is described with reference to FIGS. 14A to 15.

(First Fluorescent Ink)

Figure 14A:
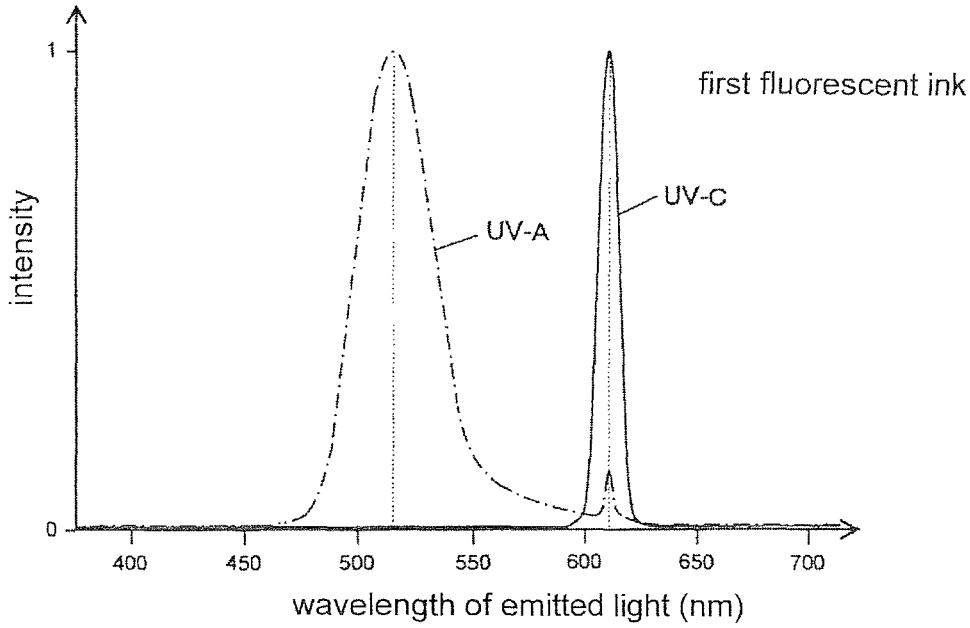
FIG. 14A is a view showing a fluorescence emission spectrum of a first fluorescent ink, in a modification example of the second embodiment of the present invention.

As shown in FIG. 14A, a first fluorescent ink 13 emits light of green color having a peak wavelength $\lambda_{1A}$ of about 514 nm upon irradiation of UV-A, and emits light of red color having a peak wavelength $\lambda_{1C}$ of about 610 nm. For example, a fluorescent material DCP No. 4 (manufactured by Nemoto & Co., Ltd.) is used as a dichromic fluorescent material (first fluorescent material) for such a first fluorescent ink 13.

(Second Fluorescent Ink)

Figure 14B:
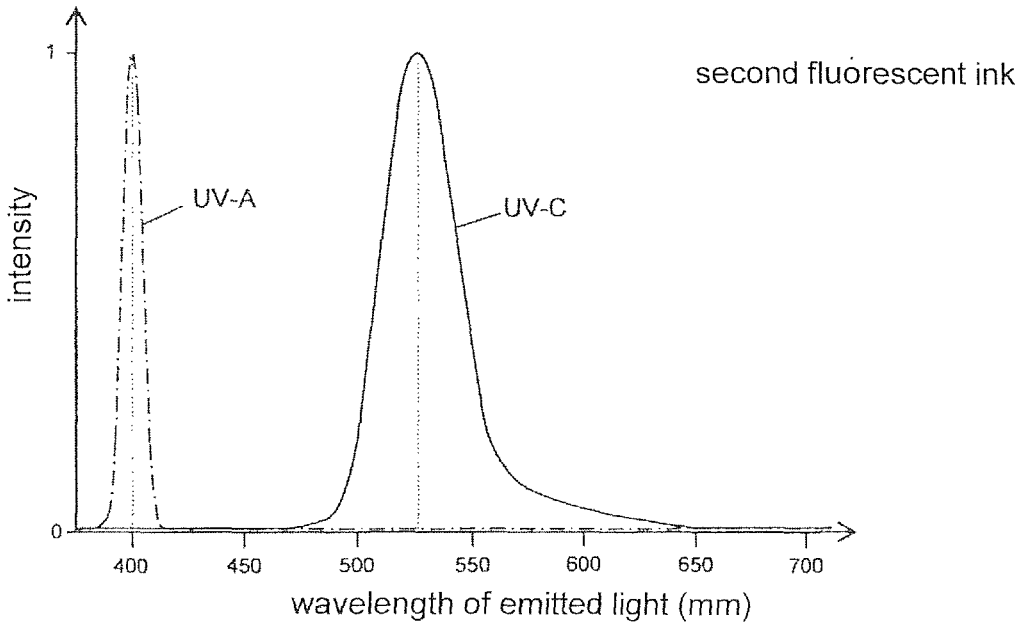
FIG. 14B is a view showing a fluorescence emission spectrum of a second fluorescent ink, in the modification example of the second embodiment of the present invention.

As shown in FIG. 14B, upon irradiation of the UV-A, the second fluorescent ink 14 emits light of blue color having a peak wavelength $\lambda_{2A}$ of about 400 nm. Upon irradiation of the UV-C, the second fluorescent ink 14 emits light of green color having a peak wavelength $\lambda_{2C}$ of about 525 nm. For example, a fluorescent material DCP No. 5 (manufactured by Nemoto & Co., Ltd.) is used as a dichromic fluorescent material (second fluorescent material) for such a second fluorescent ink 14.

Next, the chromaticities of light emitted from the first fluorescent ink 13 and chromaticities of light emitted from the second fluorescent ink 14, and an operation obtained based on the fluorescent light having these chromaticities are described with reference to FIG. 15.

Figure 15:
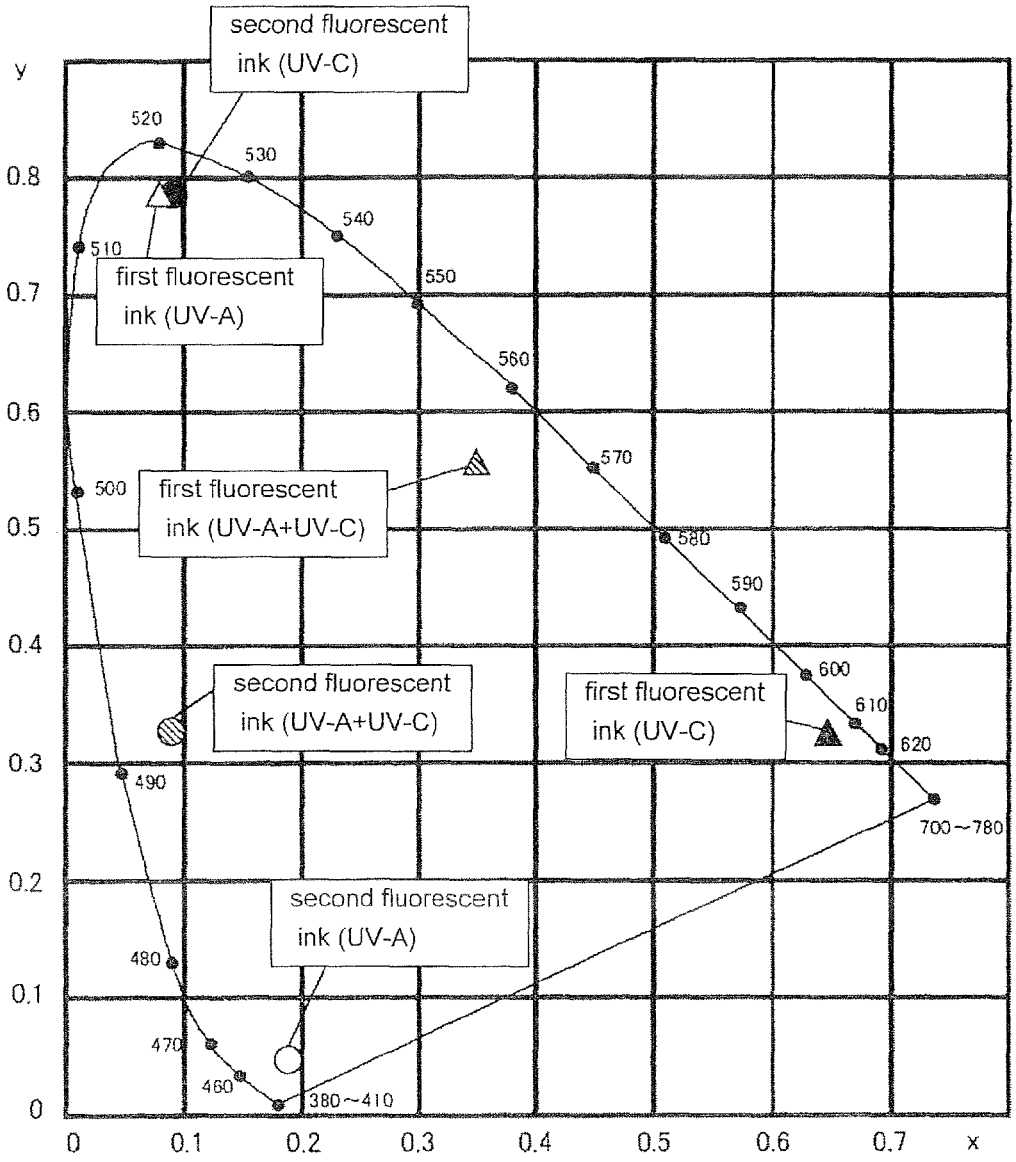
FIG. 15 is an xy chromaticity diagram showing chromaticities of fluorescent light emitted from the first fluorescent ink and chromaticities of fluorescent light emitted from the second fluorescent ink, in the modification example of the second embodiment of the present invention.

As shown in FIG. 15, the chromaticity of the light emitted from the first fluorescent light 13 upon independent irradiation of the UV-A and the chromaticity of the light emitted from the second fluorescent light 14 upon independent irradiation of the UV-A are distant from each other. The chromaticity of the light emitted from the first fluorescent light 13 upon independent irradiation of the UV-C and the chromaticity of the light emitted from the second fluorescent light 14 upon independent irradiation of the UV-C are distant from each other. The chromaticity of the light emitted from the first fluorescent light 13 upon simultaneous irradiation of the UV-A and the UV-C and the chromaticity of the light emitted from the second fluorescent light 14 upon simultaneous irradiation of the UV-A and the UV-C are distant from each other. Namely, the color of the light emitted from the first fluorescent ink 13 and the color of the light emitted from the second fluorescent ink 14 are different from each other, when the UV-A is independently irradiated, when the UV-C is independently irradiated, and when the UV-A and the UV-C are simultaneously irradiated, respectively. Thus, the pattern of the pattern area 20 of the light-emitting image 12 can be viewed, when the UV-A is independently irradiated, when the UV-C is independently irradiated, and when the UV-A and the UV-C are simultaneously irradiated, respectively.

According to this embodiment, not only when the UV-A or the UV-C are independently irradiated on the anti-counterfeit medium 10 but also when the UV-A and the UV-C are simultaneously irradiated on the anti-counterfeit medium 10, the pattern of the pattern area of the light-emitting image 12 can be viewed. Thus, according to this embodiment, the pattern of the pattern area 20 of the light-emitting image 12 can be confirmed by three color combinations. Therefore, reliability in confirmation of whether the valuable paper formed of the anti-counterfeit medium 10 is genuine or not can be further improved. Further, forging of the anti-counterfeit medium 10 can be made more difficult.

In this modification example, there is described the example in which the fluorescent material DCP No. 4 is used as the first fluorescent material of the first fluorescent ink 13, and the fluorescent material DCP No. 5 is used as the second fluorescent material of the second fluorescent ink 14. However, not limited thereto, as long as the color of the first fluorescent ink 13 and the color of the second fluorescent ink 14 are viewed as different colors from each other, when the UV-A is independently irradiated, when the UV-C is independently irradiated, and when the UV-A and the UV-C are simultaneously irradiated, respectively, various other fluorescent materials may be used as the first fluorescent material of the first fluorescent ink 13 and the second fluorescent material of the second fluorescent ink 14.

Third Embodiment

Next, a third embodiment of the present invention is described with reference to FIGS. 16 to 18C.

In the aforementioned first embodiment, there is described the example in which at least a part of the first area of the light-emitting image 12 is adjacent to the second area of the light-emitting image 12. More specifically, there is described the example in which the first area of the light-emitting image 12 is constituted by the pattern area 20, and the second area of the light-emitting image 12 is constituted by the background area 25 at least a part of which is adjacent to the pattern area 20. However, the first area and the second area are not limited to the above configuration. As long as the first area is formed of the first fluorescent ink 13 containing the first fluorescent material, and the second area is formed of the second fluorescent ink 14 containing the second fluorescent material, various other configurations of the first area and the second area can be considered.

Herebelow, with reference to FIGS. 16 to 18C, there is described an example in which a first area of a light-emitting image 12 includes at least one first design area containing a first fluorescent material, and a second area of the light-emitting image 12 includes at least one second design area containing a second fluorescent material, with the first design area and the second design area being located independently from each other. In the third embodiment shown in FIGS. 16 to 18C, the same parts as those of the first embodiment and the modification examples thereof are shown by the same reference numbers, and description thereof is omitted.

Light-Emitting Image

Figure 16:
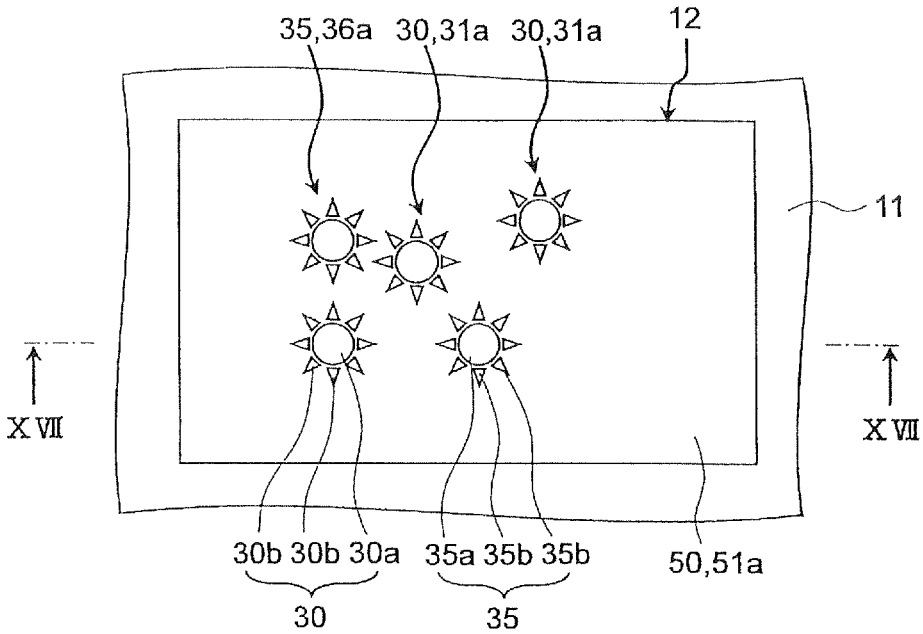
FIG. 16 is a plan view showing a light-emitting image of an anti-counterfeit medium, in a third embodiment of the present invention.
Figure 17:
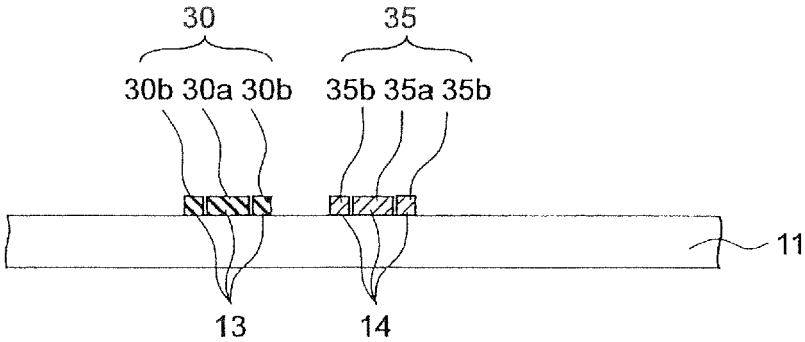
FIG. 17 is a sectional view taken along a line XVII-XVII of the light-emitting image shown in FIG. 16.

FIG. 16 is a plan view showing a light-emitting image 12 under visible light. FIG. 17 is a sectional view taken along a line XVII-XVII of the light-emitting image shown in FIG. 16. A design of the light-emitting image 12 in this embodiment is firstly described with reference to FIG. 16.

As shown in FIG. 16, the light-emitting image 12 includes a plurality of first design areas (first areas) 30 of a floral design, a plurality of second design areas (second areas) 35 of a floral design, and a blank area 50. In the example shown in FIG. 16, each first design area 30 is composed of a center of flower 30*a* and a plurality of petals 35*b* arranged around the center of flower 30*a*. Similarly, each second design area 35 is composed of a center of flower 35*a* and a plurality of petals 35*b* arranged around the center of flower 35*a*. Namely, the shape of each first design pattern 30 is substantially the same as the shape of each second design pattern 35. Herein, as described below, the expression "substantially the same" means that the shape of the first design area 30 and the shape of the second design area 35 are similar to each other, to such a degree that the first design area 30 and the second design area 35 are recognized as areas of the same kind, when the first design area 30 and the second design area 35 are viewed as areas of the same color.

The respective first design areas 30 and the respective second design areas 35 are located independently from each other. For example, as shown in FIG. 16, the one first design area 30 is located apart from the other first design areas 30 and the second design areas 35. Similarly, the one second design area 35 is located apart from the other second design areas 35 and the first design areas 30.

In the example shown in FIG. 16, the respective first design areas 30 and the respective second design areas 35 are located apart from each other. However, not limited thereto, as long as each of the first design areas 30 and each of the second design areas 35 can be recognized as separated design areas, the first design area 30 and the second design area 35 may be partially adjacent to each other or may be partially overlapped with each other. Namely, the expression "located independently from each other" means that the respective first design areas 30 and the respective second design areas 35 are located so as to be recognized as design areas that are separated from each other.

Next, a structure of the light-emitting image 12 is described with reference to FIG. 17. As shown in FIG. 17, the first deign areas 30 of the light-emitting image 12 and the second deign areas 35 thereof are formed by printing a first fluorescent ink 13 and a second fluorescent ink 14 on a substrate 11. Since a thickness of the first fluorescent ink 13 and a thickness of the second fluorescent ink 14 are substantially the same as those of the aforementioned first embodiment, detailed description thereof is omitted. Similarly to the aforementioned first embodiment, white polyethylene terephthalate is used as the substrate 11.

Similarly to the aforementioned first embodiment, the first fluorescent ink 13 and the second fluorescent ink 14 respectively contain predetermined fluorescent materials, such as particulate pigments, which do to emit light under visible light and emit light under specific invisible light. Herein, a particle diameter of the pigments contained in the inks 13 and 14 is within a range of, e.g., 0.1 to 10 μm, preferably within a range of 0.1 to 3 μm. Thus, when the visible light is irradiated on the inks 13 and 14, the light is scattered by the pigment particles. Therefore, as shown in FIG. 16, when the light-emitting image 12 is seen under the visible light, white portions 31*a* are viewed as the first design areas 30, and white portions 36*a* are viewed as the first deign area 35. As described above, the substrate 11 is formed of white polyethylene terephthalate. Thus, under the visible light, the blank area 50 is viewed as a white portion 51*a*. For this reason, all of the first design area 30 of the light-emitting image 12, the second design area 35 thereof, and the blank area 50 are viewed to exhibit a white color. As a result, under the visible light, the patterns of the respective design areas 30 and the design areas 35 will not appear. Accordingly, it is possible to prevent that the anti-counterfeit medium 10 having the light-emitting image 12 is easily forged.

Next, an operation of this embodiment as described is described. Herein, a method of manufacturing the anti-counterfeit medium 10 is firstly described. Next, there is described a method of examining whether a valuable paper formed of the anti-counterfeit medium 10 is genuine or not.

Method of Manufacturing Anti-Counterfeit Medium

At first, the substrate 11 is prepared. As the substrate 11, there is used a 188-μm thick substrate made of white polyethylene terephthalate. Then, with the use of the first fluorescent ink 13 and the second fluorescent ink 14, the light-emitting 12 including the first design areas 30 and the second design areas 35 is formed on the substrate 11 by printing.

At this time, the respective first design areas 30 and the respective second design areas 35 are located independently from each other. Thus, as compared with a case in which the first design area 30 and the second design area 35 are located to be indispensably adjacent to each other, precision required in printing is lower. Thus, by using a simpler printing method or printer, the light-emitting image 12 including the first design area 30 and the second design area 35 can be formed on the substrate 11.

As the first fluorescent ink 13 and the second fluorescent ink 14, there are used offset lithographic inks each of which is obtained by, for example, adding 8 wt % of microsilica, 2 wt % of organic bentonite, 50 wt % of alkyd resin and 15 wt % of alkyl benzene-based solvent, to 25 wt % of dichromatic fluorescent material having predetermined fluorescent properties. For example, similarly to the aforementioned first embodiment, as the dichromatic material (first fluorescent material) for the first fluorescent ink 13, there is used the fluorescent material DE-RG (manufactured by Nemoto & Co., Ltd.) that emits light of red color when being excited by the UV-C, emits light of green color when being excited by UV-A, and emits light of yellow color when being simultaneously irradiated by the UV-A and the UV-C. For example, similarly to the aforementioned first embodiment, as the dichromatic material (second fluorescent material) for the second fluorescent ink 14, there is used a fluorescent material DE-GR (manufactured by Nemoto & Co., Ltd.) that emits light of green color when being excited by the UV-C, emits light of red color when being excited by UV-A, and emits light of yellow color when being simultaneously irradiated by the UV-A and the UV-C.

Confirmation Method

Figure 18A:
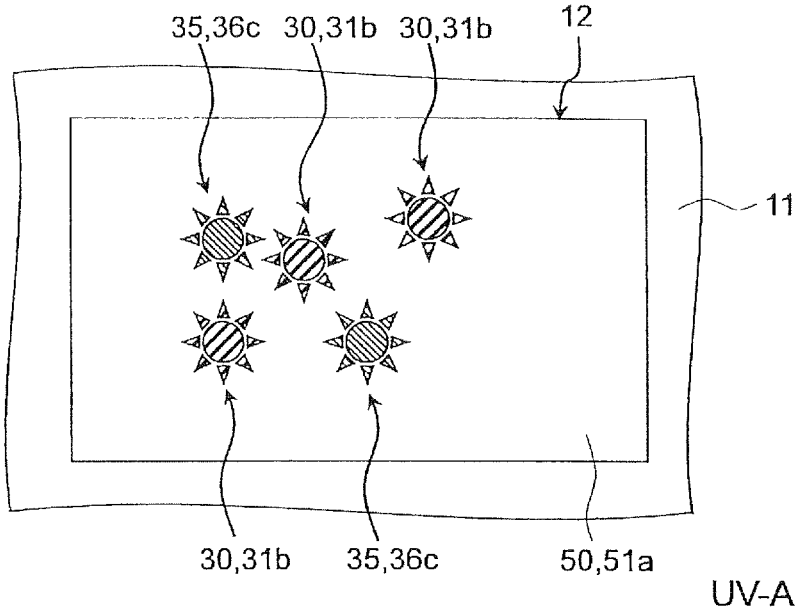
FIG. 18A is a plan view showing the light-emitting image when the UV-A is irradiated thereon, in the third embodiment of the present invention.
Figure 18B:
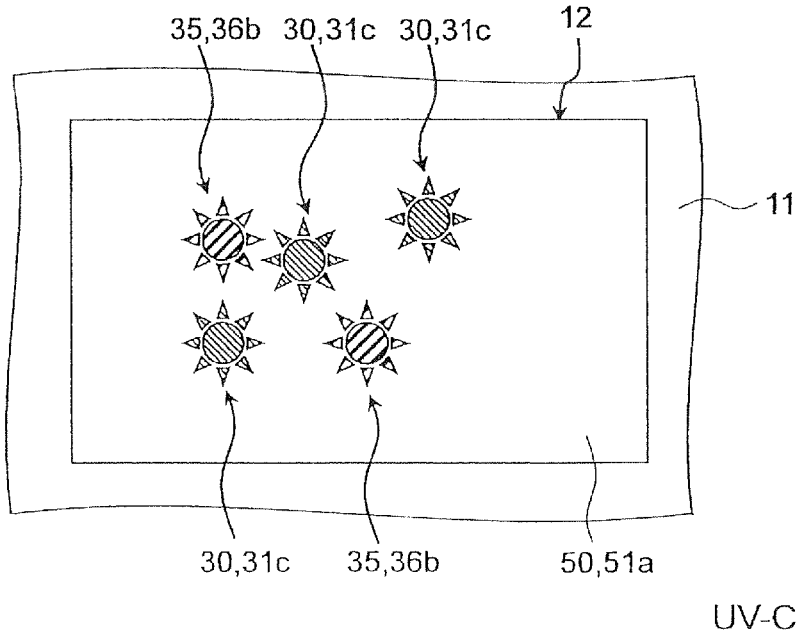
FIG. 18B is a plan view showing the light-emitting image when the UV-C is irradiated thereon, in the third embodiment of the present invention.

Next, a method of confirming whether a valuable paper formed of the anti-counterfeit medium 10 is genuine or not is described with reference to FIGS. 18A to 18C.

(Case of Irradiation of Visible Light)

At first, the anti-counterfeit medium 10 is observed under visible light. In this case, as described above, the first design areas 30 of the light-emitting image 12, the second design areas 35 thereof and the blank areas thereof are respectively viewed as to exhibit a white color (see FIG. 16). Thus, under the visible light, the patterns of the respective design areas 30 and 35 do not appear.

(Case of Irradiation of UV-A)

Then, the anti-counterfeit medium 10 when the UV-A is irradiated thereon is observed. FIG. 18A is a plan view of the light-emitting area 12 of the anti-counterfeit medium 10 when the UV-A is irradiated thereon. Since the first fluorescent ink 13 forming the respective first design areas 30 contains the fluorescent material DE-RG, the first fluorescent ink 13 emits light of green color. Thus, the respective first deign areas 30 are viewed as green portions 31*b*. On the other hand, since the second fluorescent ink 14 forming the respective second design areas 35 contains the fluorescent material DE-GR, the second fluorescent ink 14 emits light of red color. Thus, the respective second design areas 35 are viewed as red portions 36*c*. Namely, when the UV-A is irradiated, each first design area 30 and each second design area 35 are viewed as areas of different colors.

As to the color of the blank area 50 upon irradiation of the UV-A, the following cases are considered. For example, when the visible light is irradiated on the light-emitting image 12 simultaneously with the UV-A, as shown in FIG. 18A, the blank area 50 is viewed as a white portion 51*a*. On the other hand, only the UV-A is irradiated on the light-emitting image 12 while the visible light is shielded, the blank area 50 is viewed as an achromatic portion, although not shown.

(Case of Irradiation of UV-C)

Then, the anti-counterfeit medium 10 when the UV-C is irradiated thereon is observed. FIG. 18B is a plan view showing the light-emitting image 12 of the anti-counterfeit medium 10 when the UV-C is irradiated thereon. Since the first fluorescent ink 13 forming the respective first design areas 30 contains the fluorescent material DE-RG, the first fluorescent ink 13 emits light of red color. Thus, the respective first deign areas 30 are viewed as red portions 31*c*. On the other hand, since the second fluorescent ink 14 forming the respective second design areas 35 contains the fluorescent material DE-GR, the second fluorescent ink 14 emits light of green color. Thus, the respective second design areas 35 are viewed as green portions 36*b*. Namely, when the UV-C is irradiated, each first design area 30 and each second design area 35 are viewed as areas of different colors.

As to the color of the blank area 50 upon irradiation of the UV-C, the following cases are considered. For example, when the visible light is irradiated on the light-emitting image 12 simultaneously with the UV-C, as shown in FIG. 18B, the blank area 50 is viewed as a white portion 51*a*. On the other hand, only the UV-C is irradiated on the light-emitting image 12 while the visible light is shielded, the blank area 50 is viewed as an achromatic portion, although not shown.

When the visible light, the UV-A or the UV-C is irradiated, by examining whether the colors of the respective first design areas 30 and the respective second design areas 35 change in the manner as described above, whether the valuable paper formed of the anti-counterfeit medium 10 is genuine or not can be confirmed.

In this embodiment, the color of the light emitted from the first fluorescent ink 13 upon irradiation of the UV-A and the color of the light emitted from the second fluorescent ink 14 upon irradiation of the UV-C are the same with each other. In addition, the color of the light emitted from the first fluorescent ink 13 upon irradiation of the UV-C and the color of the light emitted from the second fluorescent ink 14 upon irradiation of the UV-A are the same with each other. Thus, when the light irradiated on the light-emitting image 12 including the first deign area 30 and the second design area 35 is switched between the UV-A and the UV-C, the color of the first design area 30 and the color of the second design area 35 are reversed (switched) from each other.

In this manner, by examining whether the color of the pattern area 20 and the color of the background area 25 are reversed from each other, when the irradiated light is switched from the UV-A to the UV-C and vice versa, reliability in confirmation of whether the valuable paper formed of the anti-counterfeit medium 10 is genuine or not can be further improved.

(Case of Simultaneous Irradiation of UV-A and UV-C)

Then, the anti-counterfeit medium 10 when the UV-A and the UV-C are simultaneously irradiated thereon is observed.

Figure 18C:
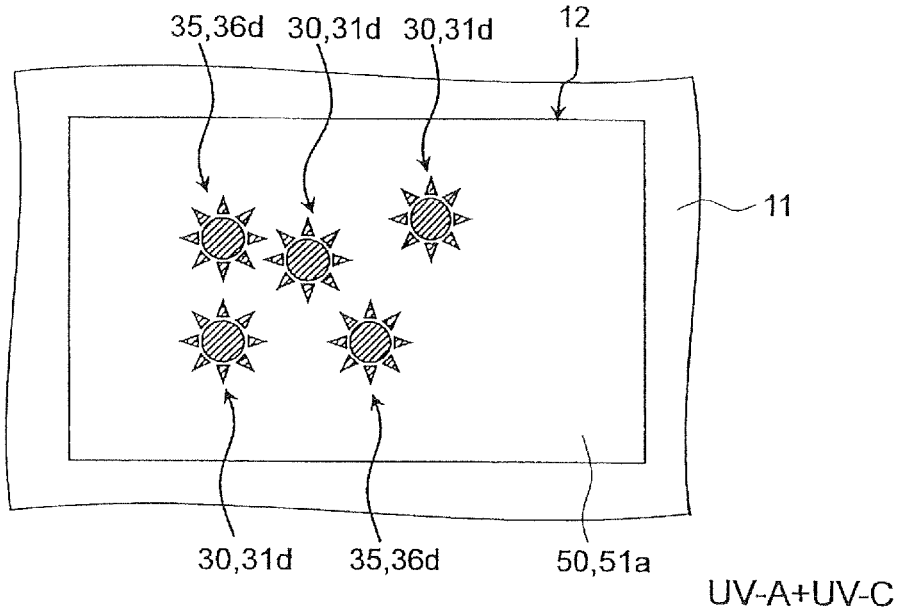
FIG. 18C is a plan view showing the light-emitting image when the UV-A and the UV-C are simultaneously irradiated thereon, in the third embodiment of the present invention.

FIG. 18C is a plan view showing the light-emitting image 12 of the anti-counterfeit medium 10 when the UV-A and the UV-C are simultaneously irradiated thereon. In this case, the first fluorescent ink 13 emits light of yellow color which is an additive mixture of the light of green color upon irradiation of the UV-A and the light of red color upon irradiation of the UV-C. On the other hand, the second fluorescent ink 14 emits light of yellow color which is an additive mixture of the light of red color upon irradiation of the UV-A and the light of green color upon irradiation of the UV-C. Thus, as shown in FIG. 18C, the first design areas 30 are viewed as yellow portion 31*d*, and the second design areas 35 are also viewed as yellow portion 36*d*. Namely, when the UV-A and the UV-C are simultaneously irradiated, the first design area 30 and the second design area 35 are viewed as areas of the same color. Thus, when the UV-A and the UV-C are simultaneously irradiated, each first design area 30 and each second design area 35 are viewed as areas of the same color.

When the visible light, the UV-A or the UV-C is independently irradiated, and when the UV-A and the UV-C are simultaneously irradiated, by examining whether the colors of the respective first design areas 30 and the respective second design areas 35 change in the manner as described above, whether the valuable paper formed of the anti-counterfeit medium 10 is genuine or not can be confirmed.

According to this embodiment, since the plurality of design areas 30 and 35 are formed in the light-emitting image 12, and the different fluorescent materials are used for the respective deign areas 30 and 35, the number of design variations of the light-emitting image 12 can be increased. Thus, design of the light-emitting image 12 can be improved.

Modification Example

In this embodiment, there is described the example in which each first design area 30 formed of the first fluorescent ink 13 has the floral shape, and each second design area 35 formed of the second fluorescent ink 14 has the floral shape. However, the shape of the first design area 30 and the shape of the second design area 35, which are included in the light-emitting image 12, is not limited to one kind. For example, as shown in FIG. 19, in addition to the floral shape, the first design area 30 and the second design area 35 may include a star-like one.

Figure 19:
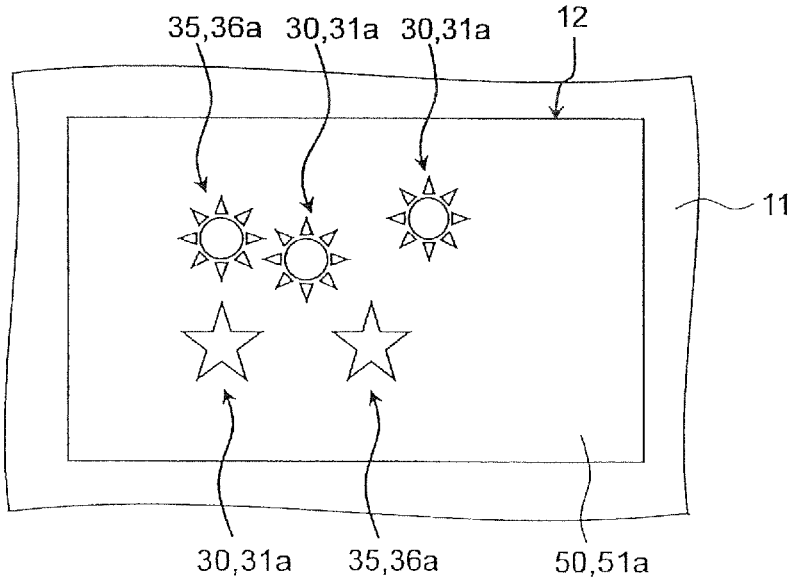
FIG. 19 is a plan view showing a light-emitting image of an anti-counterfeit medium in a modification example of the third embodiment of the present invention.

In the example shown in FIG. 19, similarly to the first design area 30 of a floral shape, the first design area 30 of a star-like shape is formed of the first fluorescent ink 13 containing the first fluorescent material. Similarly, the second design area 35 of a star-like shape is formed of the second fluorescent ink 14 containing the second fluorescent material, similarly to the second design area 35 of a floral shape. Thus, when the UV-A is independently irradiated and when the UV-C is independently irradiated, the first design area 30 and the second design area 35 are viewed as areas of different colors. On the other hand, when the UV-A and the UV-C are simultaneously irradiated, the first design area 30 and the second design area 35 are viewed as areas of the same color.

According to the example shown in FIG. 19, by increasing the shape variations of each first design area 30 and each second design area 35, the structure of the light-emitting image can be more complicated. Thus, forging of the anti-counterfeit medium 10 can be further made difficult. In addition, design of the light-emitting image 12 can be improved.

In this embodiment and its modification example, there is described the following example. Namely, when the UV-A is independently irradiated or when the UV-C is independently irradiated, the first fluorescent ink 13 and the second fluorescent ink 14 are recognized to exhibit as different colors from each other. When the UV-A and the UV-C are simultaneously irradiated, the first fluorescent ink 13 and the second fluorescent ink 14 are viewed to exhibit the same color with each other. In addition, when the irradiated light is switched between the UV-A and the UV-C, the color of the first fluorescent ink 13 and the color of the second fluorescent ink 14 are reversed from each other. However, not limited thereto, when the UV-A and the UV-C are simultaneously irradiated, the first fluorescent ink 13 and the second fluorescent ink 14 may be viewed to exhibit different colors, similarly to the aforementioned second embodiment. In addition, similarly to the third modification example of the aforementioned first embodiment or the modification example of the aforementioned second embodiment, when the UV-A and the UV-C are switched, the color of the first fluorescent ink 13 and the color of the second fluorescent ink 14 may not be in the reverse relationship.

Other Modification Example

In the aforementioned second and third embodiments, there is described the example in which inks having excitation properties with respect to the UV-A and the UV-C are used as the first fluorescent ink 13 and the second fluorescent ink 14. However, not limited thereto, an ink having excitation properties with respect to UV-B or infrared light may be used as the first fluorescent ink 13 and the second fluorescent ink 14. Namely, invisible light within any given wavelength range may be used as the "invisible light within a first wavelength range" or the "invisible light within a second wavelength range" of the present invention.

In addition, in the aforementioned second and third embodiments, there is described the example in which the light-emitting medium of the present invention is used as the anti-counterfeit medium constituting a valuable paper or the like. However, not limited thereto, the light-emitting medium of the present invention can be used in various other applications. For example, the light-emitting medium of the present invention is applied to, e.g., a toy.

The invention claimed is:

1. A light-emitting medium including a light-emitting image on a substrate, wherein:

the light-emitting image includes a first area containing a first fluorescent material and a second area containing a second fluorescent material;

when invisible light within a first wavelength range is irradiated, the first fluorescent material and the second fluorescent material emit light of colors that are viewed as different colors from each other;

when invisible light within a second wavelength range is irradiated, the first fluorescent material and the second fluorescent material emit light of colors that are viewed as different colors from each other, the colors being different from the colors that are viewed when the invisible light within the first wavelength range is irradiated; and when the invisible light within the first wavelength range and the invisible light within the second wavelength range are simultaneously irradiated, the first fluorescent material and the second fluorescent material emit light of colors that are viewed as the same color with each other.

2. The light-emitting medium according to claim 1, wherein when the invisible light within the first wavelength range and the invisible light within the second wavelength range are simultaneously irradiated, a color difference between the color of the light emitted from the first fluorescent material and the color of the light emitted from the second fluorescent material is not more than 10.

3. The light-emitting medium according to claim 1, wherein when the invisible light within the first wavelength range and the invisible light within the second wavelength range are simultaneously irradiated, a color difference between the color of the light emitted from the first fluorescent material and the color of the light emitted from the second fluorescent material is not more than 3.

4. The light-emitting medium according to claim 1, wherein the first fluorescent material emits light of a first color when the invisible light within the first wavelength range is irradiated, and emits light of a second color when the invisible light within the second wavelength range is irradiated, and the second fluorescent material emits light of the second color or light of a color that is viewed as the same color with the second color when the invisible light within the first wavelength range is irradiated, and emits light of the first color or light of a color that is viewed as the same color with the first color when the invisible light within the second wavelength range is irradiated.

5. The light-emitting medium according to claim 4, wherein a color difference between the color of the light emitted from the first fluorescent material, when the invisible light within the first wavelength range is irradiated, and the color of the light emitted from the second fluorescent material, when the invisible light within the second wavelength range is irradiated, is not more than 10, and a color difference between the color of the light emitted from the second fluorescent material, when the invisible light within the first wavelength range is irradiated, and the color of the light emitted from the first fluorescent material, when the invisible light within the second wavelength range is irradiated, is not more than 10.

6. The light-emitting medium according to claim 4, wherein a color difference between the color of the light emitted from the first fluorescent material, when the invisible light within the first wavelength range is irradiated, and the color of the light emitted from the second fluorescent material, when the invisible light within the second wavelength range is irradiated, is not more than 3, and a color difference between the color of the light emitted from the second fluorescent material, when the invisible light within the first wavelength range is irradiated, and the color of the light emitted from the first fluorescent material, when the invisible light within the second wavelength range is irradiated, is not more than 3.

7. The light-emitting medium according to claim 1, wherein when the invisible light within the first wavelength range and the invisible light within the second wavelength range are simultaneously irradiated, the first fluorescent material and the second fluorescent material emit light of colors that are viewed as the same color with each other, the colors being viewed as the same color with a color of the substrate.

8. The light-emitting medium according to claim 1, wherein the first area and the second area are respectively formed of the first fluorescent material and the second fluorescent material provided in an identical predetermined pattern.

9. The light-emitting medium according to claim 1, wherein at least a part of the second area is adjacent to the first area.

10. The light-emitting medium according to claim 1, wherein the first area includes at least one first design area containing the first fluorescent material;

the second area includes at least one second design area containing the second fluorescent material; and the first design area and the second design area are located independently from each other.

11. The light-emitting medium according to claim 10, wherein a shape of the first deign area is substantially the same as a shape of the second design area.

12. A light-emitting medium including a light-emitting image on a substrate, wherein:

the light-emitting image includes a first area containing a first fluorescent material and a second area containing a second fluorescent material;

when invisible light within a first wavelength range is irradiated, the first fluorescent material and the second fluorescent material emit light of colors that are viewed as different colors from each other;

when invisible light within a second wavelength range is irradiated, the first fluorescent material and the second fluorescent material emit light of colors that are viewed as different colors from each other, the colors being different from the colors that are viewed when the invisible light within the first wavelength range is irradiated;

the first fluorescent material emits light of a first color when the invisible light within the first wavelength range is irradiated, and emits light of a second color when the invisible light within the second wavelength range is irradiated; and the second fluorescent material emits light of the second color or light of a color that is viewed as the same color with the second color when the invisible light within the first wavelength range is irradiated, and emits light of the first color or light of a color that is viewed as the same color with the first color when the invisible light within the second wavelength range is irradiated.

13. The light-emitting medium according to claim 12, wherein a color difference between the color of the light emitted from the first fluorescent material, when the invisible light within the first wavelength range is irradiated, and the color of the light emitted from the second fluorescent material, when the invisible light within the second wavelength range is irradiated, is not more than 10, and a color difference between the color of the light emitted from the second fluorescent material, when the invisible light within the first wavelength range is irradiated, and the color of the light emitted from the first fluorescent material, when the invisible light within the second wavelength range is irradiated, is not more than 10.

14. The light-emitting medium according to claim 12, wherein a color difference between the color of the light emitted from the first fluorescent material, when the invisible light within the first wavelength range is irradiated, and the color of the light emitted from the second fluorescent material, when the invisible light within the second wavelength range is irradiated, is not more than 3, and a color difference between the color of the light emitted from the second fluorescent material, when the invisible light within the first wavelength range is irradiated, and the color of the light emitted from the first fluorescent material, when the invisible light within the second wavelength range is irradiated, is not more than 3.

15. The light-emitting medium according to claim 12, wherein when the invisible light within the first wavelength range and the invisible light within the second wavelength range are simultaneously irradiated, the first fluorescent material and the second fluorescent material emit light of colors that are viewed as the same color with each other, the colors being viewed as the same color with a color of the substrate.

16. The light-emitting medium according to claim 12, wherein the first area and the second area are respectively formed of the first fluorescent material and the second fluorescent material provided in an identical predetermined pattern.

17. The light-emitting medium according to claim 12, wherein at least a part of the second area is adjacent to the first area.

18. The light-emitting medium according to claim 12, wherein:

the first area includes at least one first design area containing the first fluorescent material;

the second area includes at least one second design area containing the second fluorescent material; and the first design area and the second design area are located independently from each other.

19. The light-emitting medium according to claim 18, wherein a shape of the first deign area is substantially the same as a shape of the second design area.

20. A method of confirming a light-emitting medium including a light-emitting image on a substrate, the method comprising:

preparing a light-emitting medium according to claim 1;

confirming that the first area of the light-emitting image and the second area thereof are discriminated from each other upon irradiating the invisible light within the first wavelength range on the light-emitting medium; and confirming that the first area of the light-emitting image and the second area thereof are discriminated from each other upon irradiating the invisible light within the second wavelength range on the light-emitting medium.

21. The method of confirming a light-emitting medium according to claim 20 further comprising confirming that the first area of the light-emitting image and the second area thereof are not discriminated from each other, by simultaneously irradiating the invisible light within the first wavelength range and the invisible light within the second wavelength range.

22. A method of confirming a light-emitting medium including a light-emitting image on a substrate, the method comprising:

preparing a light-emitting medium according to claim 12;

confirming that the first area of the light-emitting image and the second area thereof are discriminated from each other upon irradiating the invisible light within the first wavelength range on the light-emitting medium; and confirming that the first area of the light-emitting image and the second area thereof are discriminated from each other upon irradiating the invisible light within the second wavelength range on the light-emitting medium.

23. The method of confirming a light-emitting medium according to claim 22 further comprising confirming that the first area of the light-emitting image and the second area thereof are not discriminated from each other, by simultaneously irradiating the invisible light within the first wavelength range and the invisible light within the second wavelength range.

* * * * *